US010829864B2

(12) United States Patent
Kramer et al.

(10) Patent No.: US 10,829,864 B2
(45) **Date of Patent: *Nov. 10, 2020**

(54) APPARATUS AND METHODS FOR UNIFORMLY FORMING POROUS SEMICONDUCTOR ON A SUBSTRATE

(71) Applicant: TruTag Technologies, Inc., Kapolei, HI (US)

(72) Inventors: Karl-Josef Kramer, San Jose, CA (US); Mehrdad M. Moslehi, Los Altos, CA (US); Subramanian Tamilmani, San Jose, CA (US); George Kamian, Scotts Valley, CA (US); Jay Ashjaee, Cupertino, CA (US); Takao Yonehara, Milpitas, CA (US)

(73) Assignee: TruTag Technologies, Inc., Kapolei, HI (US)

( * ) Notice: Subject to any disclaimer, the term of this patent is extended or adjusted under 35 U.S.C. 154(b) by 20 days.

This patent is subject to a terminal disclaimer.

(21) Appl. No.: 15/851,023

(22) Filed: Dec. 21, 2017

(65) Prior Publication Data

US 2018/0347063 A1 Dec. 6, 2018

Related U.S. Application Data

(63) Continuation of application No. 14/563,888, filed on Dec. 8, 2014, now Pat. No. 9,890,465, which is a (Continued)

(51) Int. Cl.
*C30B 1/02* (2006.01)
*C25D 11/00* (2006.01)
(Continued)

(52) U.S. Cl.
CPC ..... *C25D 11/005* (2013.01); *C25D 7/12* (2013.01); *C25D 11/022* (2013.01);
(Continued)

(58) Field of Classification Search
CPC ..... C25D 11/005; C25D 11/024; C25D 11/22; C25D 17/08; C30B 35/00; C30B 1/02; C30B 1/04
See application file for complete search history.

(56) References Cited

U.S. PATENT DOCUMENTS 4,043,894 A 8/1977 Gibbs
4,070,206 A 1/1978 Kressel
(Continued)

FOREIGN PATENT DOCUMENTS

CN 1188820 7/1998
DE 4141083 A1 6/1993
(Continued)

OTHER PUBLICATIONS

Alvin D. Compaan, Photovoltaics: Clean Power for the 21st Century, Solar Energy Materials & Solar Cells, 2006, pp. 2170-2180, vol. 90, Elsevier B.V.
(Continued)

*Primary Examiner* — Robert M Kunemund
(74) *Attorney, Agent, or Firm* — Van Pelt, Yi & James LLP

(57) ABSTRACT

This disclosure enables high-productivity controlled fabrication of uniform porous semiconductor layers (made of single layer or multi-layer porous semiconductors such as porous silicon, comprising single porosity or multi-porosity layers). Some applications include fabrication of MEMS separation and sacrificial layers for die detachment and MEMS device fabrication, membrane formation and shallow trench isolation (STI) porous silicon (using porous silicon formation with an optimal porosity and its subsequent oxidation). Further, this disclosure is applicable to the general fields of photovoltaics, MEMS, including sensors and actuators, stand-alone, or integrated with integrated
(Continued)

semiconductor microelectronics, semiconductor microelectronics chips and optoelectronics.

22 Claims, 12 Drawing Sheets

Related U.S. Application Data continuation of application No. 13/288,721, filed on Nov. 3, 2011, now Pat. No. 8,906,218, and a continuation-in-part of application No. 12/774,667, filed on May 5, 2010, now Pat. No. 8,999,058, which is a continuation-in-part of application No. 13/244,466, filed on Sep. 24, 2011, now Pat. No. 9,076,642, and a continuation-in-part of application No. 12/774,667, filed on May 5, 2010, now Pat. No. 8,999,058, and a continuation-in-part of application No. 12/688,495, filed on Jan. 15, 2010, now Pat. No. 8,926,803.

(60) Provisional application No. 61/409,940, filed on Nov. 3, 2010, provisional application No. 61/175,535, filed on May 5, 2009, provisional application No. 61/386,318, filed on Sep. 24, 2010, provisional application No. 61/145,018, filed on Jan. 15, 2009.

(51) Int. Cl.

| | |
|---|---|
| ***C25D 21/04*** | (2006.01) |
| ***C25D 17/08*** | (2006.01) |
| ***C25D 17/00*** | (2006.01) |
| ***C25F 7/00*** | (2006.01) |
| ***C25D 11/32*** | (2006.01) |
| ***C25D 11/02*** | (2006.01) |
| ***C25D 7/12*** | (2006.01) |

(52) U.S. Cl.
CPC ..... *C25D 11/024* (2013.01); *C25D 11/32* (2013.01); *C25D 17/001* (2013.01); *C25D 17/008* (2013.01); *C25D 17/08* (2013.01); *C25D 21/04* (2013.01); *C25F 7/00* (2013.01)

(56) References Cited

U.S. PATENT DOCUMENTS

| | | | | |
|---|---|---|---|---|
| 4,082,570 | A | 4/1978 | House | |
| 4,165,252 | A | 8/1979 | Gibbs | |
| 4,249,959 | A | 2/1981 | Jebens | |
| 4,251,679 | A | 2/1981 | Zwan | |
| 4,348,254 | A | 9/1982 | Lindmayer | |
| 4,361,950 | A | 12/1982 | Amick | |
| 4,409,423 | A | 10/1983 | Holt | |
| 4,427,839 | A | 1/1984 | Hall | |
| 4,430,519 | A | 2/1984 | Young | |
| 4,461,922 | A | 7/1984 | Gay | |
| 4,479,847 | A | 10/1984 | McCaldin | |
| 4,626,613 | A | 12/1986 | Wenham | |
| 4,661,212 | A | 4/1987 | Ehrfeld | |
| 4,672,023 | A | 6/1987 | Leung | |
| 4,922,277 | A | 5/1990 | Carlson | |
| 5,024,953 | A | 6/1991 | Uematsu | |
| 5,073,230 | A | 12/1991 | Maracas | |
| 5,112,453 | A | 5/1992 | Behr | |
| 5,208,068 | A | 5/1993 | Davis | |
| 5,248,621 | A | 9/1993 | Sano | |
| 5,316,593 | A | 5/1994 | Olson | |
| 5,348,618 | A | 9/1994 | Canham | |
| 5,358,600 | A | 10/1994 | Canham | |
| 5,397,400 | A | 3/1995 | Matsuno | |
| 5,458,755 | A | 10/1995 | Fujiyama | |
| 5,459,099 | A | 10/1995 | Hsu | |
| 5,494,832 | A | 2/1996 | Lehmann | |
| 5,538,564 | A | 7/1996 | Kaschmitter | |
| 5,616,185 | A | 4/1997 | Kukulka | |
| 5,645,684 | A | 7/1997 | Keller | |
| 5,660,680 | A | 8/1997 | Keller | |
| 5,679,233 | A | 10/1997 | Van Anglen | |
| 5,681,392 | A | 10/1997 | Swain | |
| 5,689,603 | A | 11/1997 | Huth | |
| 5,704,992 | A | 1/1998 | Willeke | |
| 5,882,988 | A | 3/1999 | Haberern | |
| 5,899,360 | A | 5/1999 | Mack | |
| 5,928,438 | A | 7/1999 | Salami | |
| 5,951,833 | A | 9/1999 | Yamagata | |
| 5,994,640 | A | 11/1999 | Bansemir | |
| 6,058,945 | A | 5/2000 | Fujiyama | |
| 6,091,021 | A | 7/2000 | Ruby | |
| 6,096,229 | A | 8/2000 | Shahid | |
| 6,114,046 | A | 9/2000 | Hanoka | |
| 6,127,623 | A | 10/2000 | Nakamura | |
| 6,143,629 | A | 11/2000 | Sato | |
| 6,197,654 | B1 | 3/2001 | Swanson | |
| 6,204,443 | B1 | 3/2001 | Kiso | |
| 6,225,193 | B1 | 5/2001 | Simpson | |
| 6,235,147 | B1 | 5/2001 | Lee | |
| 6,254,759 | B1 | 7/2001 | Rasmussen | |
| 6,258,244 | B1 | 7/2001 | Ohmi | |
| 6,294,725 | B1 | 9/2001 | Hirschberg | |
| 6,331,208 | B1 | 12/2001 | Nishida | |
| 6,399,143 | B1 | 6/2002 | Sun | |
| 6,416,647 | B1 | 7/2002 | Dordi | |
| 6,417,069 | B1 | 7/2002 | Sakaguchi | |
| 6,428,620 | B1 | 8/2002 | Yamagata | |
| 6,429,037 | B1 | 8/2002 | Wenham | |
| 6,441,297 | B1 | 8/2002 | Keller | |
| 6,448,155 | B1 | 9/2002 | Iwasaki | |
| 6,461,932 | B1 | 10/2002 | Wang | |
| 6,517,697 | B1 | 2/2003 | Yamagata | |
| 6,524,880 | B2 | 2/2003 | Moon | |
| 6,534,336 | B1 | 3/2003 | Iwane | |
| 6,551,908 | B2 | 4/2003 | Ukiyo | |
| 6,555,443 | B1 | 4/2003 | Artmann | |
| 6,566,235 | B2 | 5/2003 | Nishida | |
| 6,602,760 | B2 | 8/2003 | Poortmans | |
| 6,602,767 | B2 | 8/2003 | Nishida | |
| 6,613,148 | B1 | 9/2003 | Rasmussen | |
| 6,624,009 | B1 | 9/2003 | Green | |
| 6,645,833 | B2 | 11/2003 | Brendel | |
| 6,649,485 | B2 | 11/2003 | Solanki | |
| 6,653,722 | B2 | 11/2003 | Blalock | |
| 6,664,169 | B1 | 12/2003 | Iwasaki | |
| 6,726,815 | B1 | 4/2004 | Artmann | |
| 6,756,289 | B1 | 6/2004 | Nakagawa | |
| 6,818,104 | B2 | 11/2004 | Iwasaki | |
| 6,881,644 | B2 | 4/2005 | Malik | |
| 6,946,052 | B2 | 9/2005 | Yanagita | |
| 6,964,732 | B2 | 11/2005 | Solanki | |
| 7,014,748 | B2 | 3/2006 | Matsumura | |
| 7,022,585 | B2 | 4/2006 | Solanki | |
| 7,026,237 | B2 | 4/2006 | Lamb | |
| 7,309,658 | B2 | 12/2007 | Lazovsky | |
| 7,368,756 | B2 | 5/2008 | Bruhns | |
| 7,402,523 | B2 | 7/2008 | Nishimura | |
| 7,745,313 | B2 | 6/2010 | Wang | |
| 7,786,376 | B2 | 8/2010 | Nag | |
| 7,999,174 | B2 | 8/2011 | Moslehi | |
| 8,035,027 | B2 | 10/2011 | Moslehi | |
| 8,035,028 | B2 | 10/2011 | Moslehi | |
| 8,053,665 | B2 | 11/2011 | Moslehi | |
| 8,084,684 | B2 | 12/2011 | Moslehi | |
| 8,129,822 | B2 | 3/2012 | Moslehi | |
| 8,168,465 | B2 | 5/2012 | Wang | |
| 8,193,076 | B2 | 6/2012 | Moslehi | |
| 8,241,940 | B2 | 8/2012 | Moslehi | |
| 8,906,218 | B2 * | 12/2014 | Kramer | C25D 11/022 205/147 |
| 8,999,058 | B2 * | 4/2015 | Kamian | H01L 31/1892 117/2 |
| 9,771,662 | B2 | 9/2017 | Yonehara | |
| 9,890,465 | B2 * | 2/2018 | Kramer | C25D 11/024 |
| 2002/0048844 | A1 | 4/2002 | Sakaguchi | |
| 2002/0079290 | A1 | 6/2002 | Holdermann | |

(56) References Cited

U.S. PATENT DOCUMENTS

| | | | |
|---|---|---|---|
| 2002/0106874 | A1 | 8/2002 | Iwane |
| 2002/0153039 | A1 | 10/2002 | Moon |
| 2002/0168592 | A1 | 11/2002 | Vezenov |
| 2002/0179140 | A1 | 12/2002 | Toyomura |
| 2003/0008473 | A1 | 1/2003 | Sakaguchi |
| 2003/0017712 | A1 | 1/2003 | Brendel |
| 2003/0039843 | A1 | 2/2003 | Johnson |
| 2003/0121773 | A1 | 7/2003 | Matsumura |
| 2003/0124761 | A1 | 7/2003 | Baert |
| 2004/0021062 | A1 | 2/2004 | Zaidi |
| 2004/0028875 | A1 | 2/2004 | Van Rijn |
| 2004/0035532 | A1 | 2/2004 | Jung |
| 2004/0173790 | A1 | 9/2004 | Yeo |
| 2004/0175893 | A1 | 9/2004 | Vatus |
| 2004/0180516 | A1 | 9/2004 | Watabe |
| 2004/0192044 | A1 | 9/2004 | Degertekin |
| 2004/0217005 | A1 | 11/2004 | Rosenfeld |
| 2004/0235406 | A1 | 11/2004 | Duescher |
| 2004/0256238 | A1 | 12/2004 | Suzuki |
| 2004/0259335 | A1 | 12/2004 | Narayanan |
| 2004/0265587 | A1 | 12/2004 | Koyanagi |
| 2005/0092600 | A1 | 5/2005 | Yoshioka |
| 2005/0160970 | A1 | 7/2005 | Niira |
| 2005/0172998 | A1 | 8/2005 | Gee |
| 2005/0176164 | A1 | 8/2005 | Gee |
| 2005/0177343 | A1 | 8/2005 | Nagae |
| 2005/0199279 | A1 | 9/2005 | Yoshimine |
| 2005/0274410 | A1 | 12/2005 | Yuuki |
| 2005/0281982 | A1 | 12/2005 | Li |
| 2006/0021565 | A1 | 2/2006 | Zahler |
| 2006/0043495 | A1 | 3/2006 | Uno |
| 2006/0054212 | A1 | 3/2006 | Fraas |
| 2006/0070884 | A1 | 4/2006 | Momoi |
| 2006/0105492 | A1 | 5/2006 | Veres |
| 2006/0105912 | A1 | 5/2006 | Konle |
| 2006/0177988 | A1 | 8/2006 | Shea |
| 2006/0196536 | A1 | 9/2006 | Fujioka |
| 2006/0231031 | A1 | 10/2006 | Dings |
| 2006/0266916 | A1 | 11/2006 | Miller |
| 2006/0270179 | A1 | 11/2006 | Yang |
| 2006/0283495 | A1 | 12/2006 | Gibson |
| 2006/0286775 | A1 | 12/2006 | Singh |
| 2007/0077770 | A1 | 4/2007 | Wang |
| 2007/0082499 | A1 | 4/2007 | Jung |
| 2007/0187257 | A1 | 8/2007 | Noji |
| 2007/0251817 | A1 | 11/2007 | Kido |
| 2008/0047601 | A1 | 2/2008 | Nag |
| 2008/0128641 | A1 | 6/2008 | Henley |
| 2008/0157283 | A1 | 7/2008 | Moslehi |
| 2008/0210294 | A1 | 9/2008 | Moslehi |
| 2008/0264477 | A1 | 10/2008 | Moslehi |
| 2008/0277885 | A1 | 11/2008 | Duff |
| 2008/0289684 | A1 | 11/2008 | Moslehi |
| 2008/0295887 | A1 | 12/2008 | Moslehi |
| 2009/0042320 | A1 | 2/2009 | Wang |
| 2009/0107545 | A1 | 4/2009 | Moslehi |
| 2009/0151784 | A1 | 6/2009 | Luan |
| 2009/0199901 | A1 | 8/2009 | Trassl |
| 2009/0260685 | A1 | 10/2009 | Lee |
| 2009/0301549 | A1 | 12/2009 | Moslehi |
| 2010/0022074 | A1 | 1/2010 | Wang |
| 2010/0116316 | A1 | 5/2010 | Moslehi |
| 2010/0144080 | A1 | 6/2010 | Ong |
| 2010/0148318 | A1 | 6/2010 | Wang |
| 2010/0148319 | A1 | 6/2010 | Wang |
| 2010/0154998 | A1 | 6/2010 | Ong |
| 2010/0175752 | A1 | 7/2010 | Wang |
| 2010/0203711 | A1 | 8/2010 | Wang |
| 2010/0267186 | A1 | 10/2010 | Wang |
| 2010/0267245 | A1 | 10/2010 | Kamian |
| 2010/0279494 | A1 | 11/2010 | Wang |
| 2010/0294333 | A1 | 11/2010 | Wang |
| 2010/0294356 | A1 | 11/2010 | Parikh |
| 2010/0300518 | A1 | 12/2010 | Moslehi |
| 2010/0304521 | A1 | 12/2010 | Seutter |
| 2010/0304522 | A1 | 12/2010 | Rana |
| 2011/0014742 | A1 | 1/2011 | Parikh |
| 2011/0030610 | A1 | 2/2011 | Kamian |
| 2011/0108098 | A1 | 5/2011 | Kapur |
| 2011/0120882 | A1 | 5/2011 | Crafts |
| 2011/0124145 | A1 | 5/2011 | Moslehi |
| 2011/0265867 | A1 | 11/2011 | Moslehi |
| 2011/0272013 | A1 | 11/2011 | Moslehi |
| 2011/0284068 | A1 | 11/2011 | Moslehi |
| 2012/0012160 | A1 | 1/2012 | Moslehi |
| 2012/0017971 | A1 | 1/2012 | Moslehi |
| 2012/0017988 | A1 | 1/2012 | Moslehi |
| 2012/0021560 | A1 | 1/2012 | Moslehi |
| 2012/0028399 | A1 | 2/2012 | Moslehi |
| 2012/0085278 | A1 | 4/2012 | Moslehi |
| 2012/0103408 | A1 | 5/2012 | Moslehi |
| 2012/0122272 | A1 | 5/2012 | Rana |
| 2012/0125256 | A1 | 5/2012 | Kramer |
| 2012/0138455 | A1 | 6/2012 | Miyaji |
| 2012/0145553 | A1 | 6/2012 | Kramer |
| 2012/0167819 | A1 | 7/2012 | Kramer |
| 2012/0171804 | A1 | 7/2012 | Moslehi |
| 2012/0174860 | A1 | 7/2012 | Moslehi |
| 2012/0174861 | A1 | 7/2012 | Wang |
| 2012/0178203 | A1 | 7/2012 | Moslehi |
| 2012/0180867 | A1 | 7/2012 | Moslehi |
| 2012/0192789 | A1 | 8/2012 | Kramer |
| 2012/0225515 | A1 | 9/2012 | Moslehi |
| 2013/0020206 | A1 | 1/2013 | Wuebben |
| 2013/0180847 | A1 | 7/2013 | Yonehara |

FOREIGN PATENT DOCUMENTS

| | | | |
|---|---|---|---|
| EP | 0334330 | A2 | 9/1989 |
| EP | 0597428 | B1 | 7/1997 |
| EP | 1024523 | A1 | 8/2000 |
| EP | 1054458 | A2 | 11/2000 |
| EP | 0879902 | B1 | 8/2003 |
| JP | 01026648 | | 2/1989 |
| JP | H05198558 | B2 | 8/1993 |
| JP | H06151406 | B2 | 5/1994 |
| JP | 06260670 | B2 | 9/1994 |
| JP | H08181103 | B2 | 7/1996 |
| JP | H10275798 | B2 | 10/1998 |
| JP | H10312990 | B2 | 11/1998 |
| JP | 2001077070 | A | 3/2001 |
| JP | 2002184709 | A | 6/2002 |
| JP | 2002299661 | B2 | 10/2002 |
| JP | 2007165844 | A | 6/2007 |
| JP | 2007324449 | B2 | 12/2007 |
| JP | 2008177563 | B2 | 7/2008 |
| JP | 2008300426 | A | 12/2008 |
| WO | WO-9641368 | A1 | 12/1996 |
| WO | WO-0028116 | A1 | 5/2000 |
| WO | WO-02055760 | | 7/2002 |
| WO | WO-2012040688 | | 3/2012 |
| WO | WO-2013126033 | | 8/2016 |

OTHER PUBLICATIONS

C.Berge, 150-mm Layer Transfer for Monocrystalline Silicon Solar Cells, Solar Energy Materials & Solar Cells, 2006, pp. 3102-3107, vol. 90, Elsevier B.V.

C.Oules et al, Silicon on Insulator Structures Obtained by Epitaxial Growth of Silicon over Porous Silicon, Journal of the Electrochemical Society, Inc., 1992, p. 3595, vol. 139, No. 12, Meylan Cedex, France.

C.S.Solanki, et al, Porous Silicon Layer Transfer Processes for Solar Cells, Solar Energy Materials & Solar Cells, 2004, pp. 101-113, vol. 83, Elsevier B.V., Leuven, Belgium.

C.S.Solanki, et al, Self-Standing Porous Silicon Films by One-Step Anodizing, Journal of Electrochemical Society, 2004, pp. C307-C314, vol. 151, The Electrochemical Society, Inc., Leuven, Belgium.

F. Duerinckx, et al, Reorganized Porous Silicon Bragg Reflectors for Thin-Film Silicon Solar Cells, IEEE Electron Device Letters, Oct. 2006, vol. 27, No. 10.

(56) References Cited

OTHER PUBLICATIONS

Francois J. Henley, Layer-Transfer Quality Cleave Principles, SiGen, Jul. 8, 2005, pp. 1-6, The Silicon Genesis Corporation, San Jose, California.
H. J. Kim, et al, Large-Area Thin-Film Free-Standing Monocrystalline Si Solar cells by Layer Transfer, Leuven, Belgium, IEEE.
J. H. Werner et al, From Polycrystalline to Single Crystalline Silicon on Glass, Thin Solid Films, 2001, pp. 95-100, vol. 383, Issue 1-2, Elsevier Science B. V., Germany.
J. J. Schermer et al., Epitaxial Lift-Off for large area thin film III/V devices, phys. Stat. sol. (a) 202, No. 4, 501-508 (2005).
Jianhua Zhao, et al, A 19.8% Efficient Honeycomb Multicrystalline Silicon Solar Cell with Improved Light Trapping, IEEE Transactions on Electron Devices, 1999, vol. 46, No. 10.
K. L. Chopra et al., Thin-Film Solar Cells: An Overview, Progress in Photovoltaics: Research and Applications, 2004, pp. 69-92, vol. 12, John Wiley & Sons, Ltd.
K. Van Nieuwenhuysen et al., Progress in epitaxial deposition on low-cost substrates for thin-film crystalline silicon solar cells at IMEC, Journal of Crystal Growth, 2006, pp. 438-441, vol. 287, Elsevier B. V. , Leuven, Belgium.
Lammert et al., The Interdigitated Back Contact Solar Cell: A Silicon Solar Cell for Use in Concentrated Sunlight, IEEE Transactions on Electron Devices, pp. 337-342.
MacDonald et al., "Design and Fabrication of Highly Topographic Nano-imprint Template for Dual Damascene Full 3-D Imprinting," Dept of Chemical Eng., University of Texas at Austin, Oct. 24, 2005.
Martin A. Green, Consolidation of Thin-Film Photovoltaic Technology: The Coming Decade of Opportunity, Progress in Photovoltaics: Research and Applications, 2006, pp. 383-392, vol. 14, John Wiley & Sons, Ltd.
Martin A. Green, Silicon Photovoltaic Modules: A Brief History of the First 50 Years, Progress in Photovoltaics: Research and Applications, 2005, pp. 447-455, vol. 13, John Wiley & Sons, Ltd.
Nobuhiko Sato et al, Epitaxial Growth on Porous Si for a New Bond and Etchback Silicon-on-Insulator, Journal of Electrochemical Society, Sep. 1995, vol. 142, No. 9, The Electrochemical Society, Inc., Hiratsuka, Japan.
P. J. Verlinden, et al, Sliver® Solar Cells: A New Thin-Crystalline Silicon Photovoltaic Technology, Solar Energy Materials & Solar Cells, 2006, pp. 3422-3430, vol. 90, Elsevier B.V.
P. R. Hageman et al., Large Area, Thin Film Epitaxial Lift Off III/V Solar Cells, 25th PVSC, May 13-17, 1996, Washington D.C., IEEE.
PCT International Preliminary Report on Patentability dated Mar. 26, 2013 issued in PCT/US2011/053183.
PCT International Preliminary Report on Patentability dated Sep. 10, 2013 issued in PCT/US2017/059177.
PCT International Search Report and Written Opinion dated Aug. 21, 2013 issued in PCT/US2011/059177.
PCT International Search Report and Written Opinion dated Jun. 27, 2012 issued in PCT/US2011/053183.
Photovoltaic Technology Research Advisory Council, A Vision for Photovoltaic Technology, 2005, pp. 1-41, European Commission Publications Office.
Prometheus Institute, U.S. Solar Industry Year in Review: U.S. Solar Energy Industry Charging Ahead, (SEIA) The Solar Energy Industry Association.
R. Brendel, et al, Sol-Gel Coatings for Light Trapping in Crystalline Thin Film Silicon Solar Cells, Journal of Non-Crystalline Solids, 1997, pp. 391-394, vol. 218, Elsevier Science B.V., Germany.
R.B. Bergmann, Crystalline Si Thin-Film Solar Cells: a Review, 1999, pp. 187-194, vol. 69, Applied Physics A Materials Science and Processing, Springer-Verlag.
Richard Auer et al, Simplified Transfer Process for High-Current Thin-Film Crystalline Si Solar Modules, 3rd World Conference on Photovoltaic Energy Conversion, May 11-18, 2003, Osaka, Japan.
Richard M. Swanson, A Vision for Crystalline Silicon Photovoltaics, Progress in Photovoltaics: Research and Applications, 2006, pp. 443-453, vol. 14, John Wiley & Sons, Ltd.
Rolf Brendel, A Novel Process for Ultrathin Monocrystalline Silicon Solar Cells on Glass, 14th European Photovolaic Solar Energy Conference, Jun. 30-Jul. 4, 1997, Barcelona, Spain.
Rolf Brendel, Review of Layer Transfer Processes for Crystalline Thin-Film Silicon Solar Cells, The Japan Journal of Applied Physics, 2001, pp. 4431-4439, vol. 40, Part 1, No. 7, The Japan Society of Applied Physics, Japan.
Rolf Brendel, Thin-Film Crystalline Silicone Mini-Modules Using Porous Si for Layer Transfer, Solar Energy, 2004, pp. 969-982, vol. 77, Elsevier Ltd., Germany.
S. Hegedus, Thin Film Solar Modules: The Low Cost, High Throughput and Versatile Alternative to Si Wafers, Progress in Photovoltaics: Research and Applications, 2006, pp. 393-411, vol. 14, John Wiley & Sons, Ltd.
Takao Yonehara, et al, Epitaxial Layer Transfer by Bond and Etch Back of Porous Si, Applied Physics Letter 64, Apr. 18, 1994, vol. 16, American Institute of Physics.
Toshiki Yagi, et al, Ray-Trace Simulation of Light Trapping in Silicon Solar Cell with Texture Structures, Solar Energy Materials & Solar Cells, 2006, pp. 2647-2656, vol. 90, Elsevier B.V.

* cited by examiner

APPARATUS AND METHODS FOR UNIFORMLY FORMING POROUS SEMICONDUCTOR ON A SUBSTRATE

CROSS REFERENCE TO OTHER APPLICATIONS

This application is a continuation of co-pending U.S. patent application Ser. No. 14/563,888, entitled APPARATUS AND METHODS FOR UNIFORMLY FORMING POROUS SEMICONDUCTOR ON A SUBSTRATE filed Dec. 8, 2014 now U.S. Pat. No. 9,890,465 which is incorporated herein by reference for all purposes, which is a continuation of U.S. patent application Ser. No. 13/288,721, now U.S. Pat. No. 8,906,218, entitled APPARATUS AND METHODS FOR UNIFORMLY FORMING POROUS SEMICONDUCTOR ON A SUBSTRATE filed Nov. 3, 2011 which is incorporated herein by reference for all purposes.

U.S. patent application Ser. No. 13/288,721 claims priority to U.S. Provisional Patent Application No. 61/409,940 entitled APPARATUS AND METHOD FOR UNIFORMLY FORMING POROUS SEMICONDUCTOR ON A SUBSTRATE filed Nov. 3, 2010 now U.S. Pat. No. 9,076,642 which is incorporated herein by reference for all purposes. U.S. patent application Ser. No. 13/288,721 is a continuation in part of U.S. patent application Ser. No. 12,774,667, now U.S. Pat. No. 8,999,058, entitled HIGH-PRODUCTIVITY POROUS SEMICONDUCTOR MANUFACTURING EQUIPMENT filed May 5, 2010, which is incorporated herein by reference for all purposes. U.S. patent application Ser. No. 13/288,721 is a continuation in part of U.S. patent application Ser. No. 13/244,466, now U.S. Pat. No. 9,076,642, entitled HIGH-THROUGHPUT BATCH POROUS SILICON MANUFACTURING EQUIPMENT DESIGN AND PROCESSING METHODS filed Sep. 24, 2011, which is incorporated herein by reference for all purposes. U.S. patent application Ser. No. 12/774,667 claims priority to U.S. Provisional Patent Application No. 61/175,535 entitled HIGH-PRODUCTIVITY POROUS SILICON MANUFACTURING EQUIPMENT filed May 5, 2009 which is incorporated herein by reference for all purposes. U.S. patent application Ser. No. 13/244,466 claims priority to U.S. Provisional Patent Application No. 61/386,318 entitled HIGH-THROUGHPUT BATCH POROUS SILICON MANUFACTURING EQUIPMENT DESIGN AND PROCESSING METHODS filed Sep. 24, 2010 which is incorporated herein by reference for all purposes. U.S. patent application Ser. No. 13/244,466 is a continuation in part of U.S. patent application Ser. No. 12/774,667, now U.S. Pat. No. 8,999,058, entitled HIGH-PRODUCTIVITY POROUS SEMICONDUCTOR MANUFACTURING EQUIPMENT filed May 5, 2010, which is incorporated herein by reference for all purposes. U.S. patent application Ser. No. 12/774,667 claims priority to U.S. Provisional Patent Application No. 61/175,535 entitled HIGH-PRODUCTIVITY POROUS SILICON MANUFACTURING EQUIPMENT filed May 5, 2009 which is incorporated herein by reference for all purposes. U.S. patent application Ser. No. 13/244,466 is a continuation in part of U.S. patent application Ser. No. 12/688,495, now U.S. Pat. No. 8,926,803, entitled POROUS SILICON ELECTRO-ETCHING SYSTEM AND METHOD filed Jan. 15, 2010, which is incorporated herein by reference for all purposes. U.S. patent application Ser. No. 12/688,495 claims priority to U.S. Provisional Patent Application No. 61/145,018 entitled POROUS SILICON ELECTRO-ETCHING SYSTEM AND METHOD filed Jan. 15, 2009 which is incorporated herein by reference for all purposes.

FIELD

The present disclosure relates in general to the fields of photovoltaics, microelectronics, and optoelectronics. And more particularly, methods, architectures, and apparatus relating to uniformly forming a porous semiconductor layer or multilayer on a substrate are disclosed.

BACKGROUND OF THE INVENTION

Currently, crystalline silicon (including multi- and monocrystalline silicon) is the most dominant absorber material for commercial photovoltaic applications, with (mono and multi) crystalline silicon modules accounting for over 80% of the photovoltaic market today. The relatively high efficiencies associated with mass-produced crystalline silicon solar cells in conjunction with the abundance of material garner appeal for continued use and advancement. But, the relatively high cost of crystalline silicon material itself (due to its dependency on polysilicon feedstock, silicon ingot growth, or cast brick formation and wafering) limits the widespread use of these solar modules. At present, the cost of "wafering", or crystallizing silicon and cutting a wafer, accounts for about 40% to 60% of the finished solar module manufacturing cost.

As an alternative to "wafering", methods of growing monocrystalline semiconductors, such as silicon, and releasing or transferring the grown wafer have been proposed. Yet regardless of the formation methods, a low cost epitaxial semiconductor, such as silicon, deposition process accompanied by a high-volume, production-worthy, uniform and reliable low cost method of forming a release layer or release layers are prerequisites for wider use of solar cells manufactured by semiconductor deposition and release processing.

Porous silicon (PS) formation is a fairly new field with an expanding application landscape. Porous silicon is often created by the electrochemical etching of silicon wafers with appropriate doping in an electrolyte bath. The electrolyte for porous silicon is: HF (49% in $H_2O$ typically), isopropyl alcohol (IPA) (and/or acetic acid) or other alcohols, such as ethanol, or combinations thereof, and deionized water (DI $H_2O$). IPA (and/or acetic acid) serves as a surfactant and assists in the uniform creation of PS. Additional additives such as certain salts or acids may be used to enhance the electrical conductivity of the electrolyte, thus reducing its heating and power consumption through ohmic losses.

Porous silicon has been utilized as a sacrificial layer in MEMS and related applications, where there is a much higher tolerance for cost per unit area of the wafer and resulting product than solar PV. Typically, porous silicon is produced using simpler and smaller single-wafer electrochemical process chambers with relatively low throughputs on smaller wafer footprints—a costly and inefficient process. The viability of this technology in solar PV applications hinges on the ability to industrialize the process to large scale (at much lower cost), requiring development of very low cost-of-ownership, high-productivity porous silicon manufacturing equipment. Designing porous silicon equipment and formation methods that allow for a high throughput, cost effective porous silicon manufacturing remains a challenge.

SUMMARY

Therefore, a need has arisen for fabrication methods and systems relating to the controlled and uniform formation of porous semiconductor material on a wafer. In accordance with the disclosed subject matter, methods, structures, and apparatus for the high-productivity controlled fabrication of uniform porous semiconductor layers are provided. The present disclosure includes several embodiments for the batch processing of semiconductor (silicon in some embodiments) wafers to produce layers of porous semiconductor. Solutions for minimizing and limiting the effect of byproduct gas formed during anodization, minimizing current leakage, and optimal wafer seals and clamps are provided. These innovations substantially reduce or eliminate disadvantages and problems associated with previously developed porous semiconductor formation methods and systems including cost reductions.

These and other advantages of the disclosed subject matter, as well as additional novel features, will be apparent from the description provided herein. The intent of this summary is not to be a comprehensive description of the subject matter, but rather to provide a short overview of some of the subject matter's functionality. Other systems, methods, features and advantages here provided will become apparent to one with skill in the art upon examination of the following FIGURES and detailed description. It is intended that all such additional systems, methods, features and advantages included within this description be within the scope of the claims.

BRIEF DESCRIPTION OF THE DRAWINGS

The features, nature, and advantages of the disclosed subject matter may become more apparent from the detailed description set forth below when taken in conjunction with the drawings in which like reference numerals indicate like features and wherein:

FIGS. 8-16B are more directly related to the subject matter disclosed in the present application;

FIG. 8 is a graph depicting a pulsed anodization over time;

FIGS. 9-12 are diagrams depicting several embodiments of a stacked batch anodizing tools in accordance with the disclosed subject matter;

FIG. 15 is a diagram depicting the electric field during anodization of wafers using the asymmetric wafer holder of FIG. 14; and FIG. 16A-B are diagrams of an alternative embodiment of an asymmetric wafer holder.

DETAILED DESCRIPTION

Figure 1:
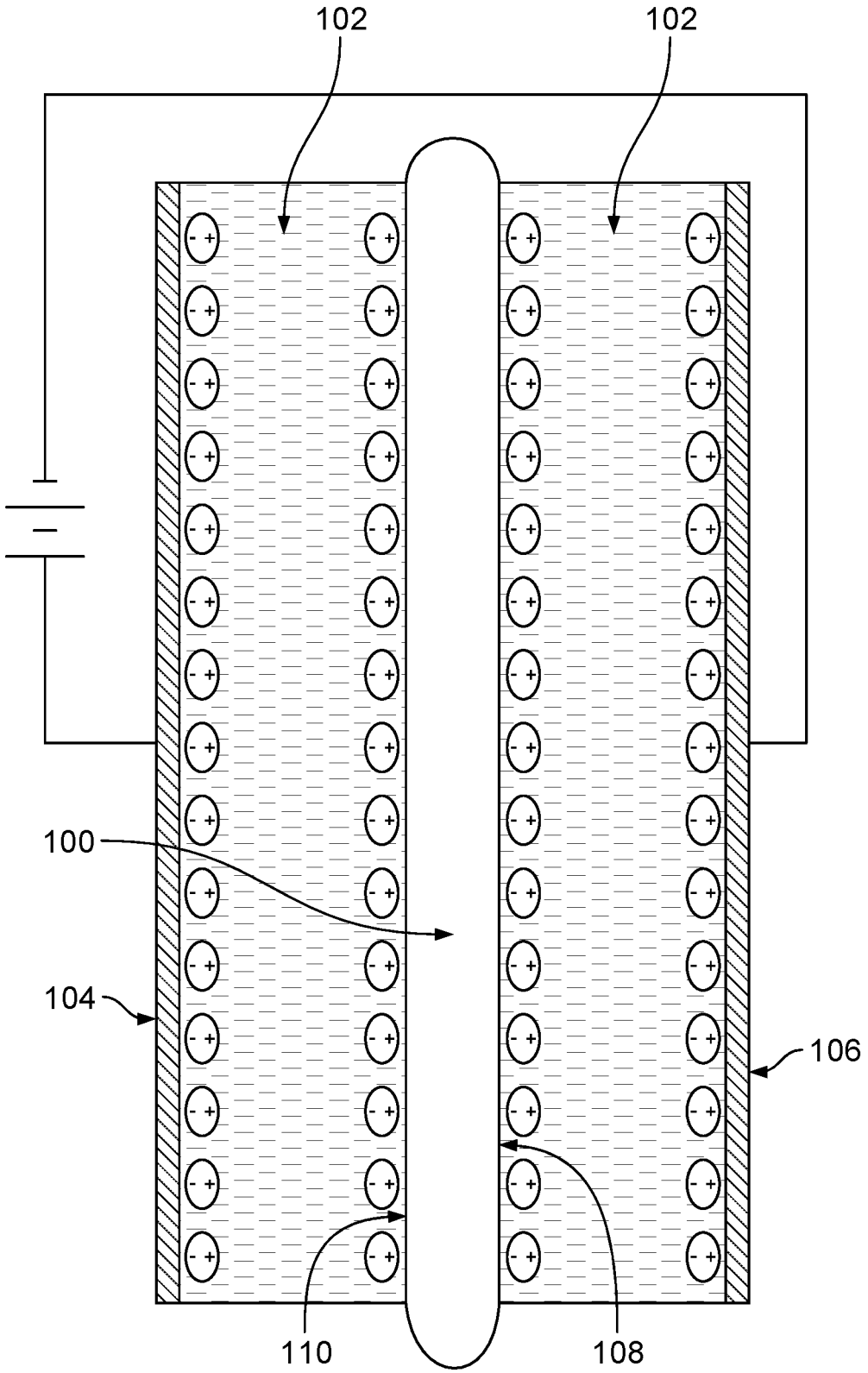
FIG. 1 (Prior Art)
FIG. 1 shows a prior-art single-wafer porous silicon electrolytic bath arrangement.

The following description is not to be taken in a limiting sense, but is made for the purpose of describing the general principles of the present disclosure. The scope of the present disclosure should be determined with reference to the claims. Exemplary embodiments of the present disclosure are illustrated in the drawings, like numbers being used to refer to like and corresponding parts of the various drawings.

And although the present disclosure is described with reference to specific embodiments, such as silicon and other fabrication materials as applied to the field of photovoltaics, one skilled in the art could apply the principles discussed herein to other materials, technical areas, and/or embodiments without undue experimentation.

A novel aspect in the porous silicon system designs and processing methods of this disclosure lies in the batch parallel or multi-wafer processing architecture (batch stack architecture), similar to low-cost large batch wet chemical processing in benches or tanks. Presently available porous silicon tools rely on single wafer processing which characteristically burdens each wafer with high capital cost, serial cumulative processing times, relatively high electrical power consumption per wafer, and excessive wafer handling/sealing resulting in potential yield losses. The novel designs of this disclosure may reduce the capital cost by a factor approximately equal to or even greater than the number of wafers in each batch stack or array. Furthermore, the proposed design simplifies and reduces the capital cost of automation, reduces the tool footprint and enables downstream rinsing and drying. FIG. 1 shows a very basic diagram of a single wafer porous silicon electrolytic bath arrangement (prior art). Wafer 100 is placed in electrolyte bath 102, between anode 104 and cathode 106. In one embodiment, electrolyte bath 102 may be HF/IPA. A porous silicon film is created on wafer frontside 108 as current is passed through the system; no porous silicon is formed on wafer backside 110. As current runs through the system, hydrogen gas may be evolved at cathode 106 and wafer front- and backside 110; oxygen gas may be evolved at anode 104 and wafer frontside 108.

Figure 2:
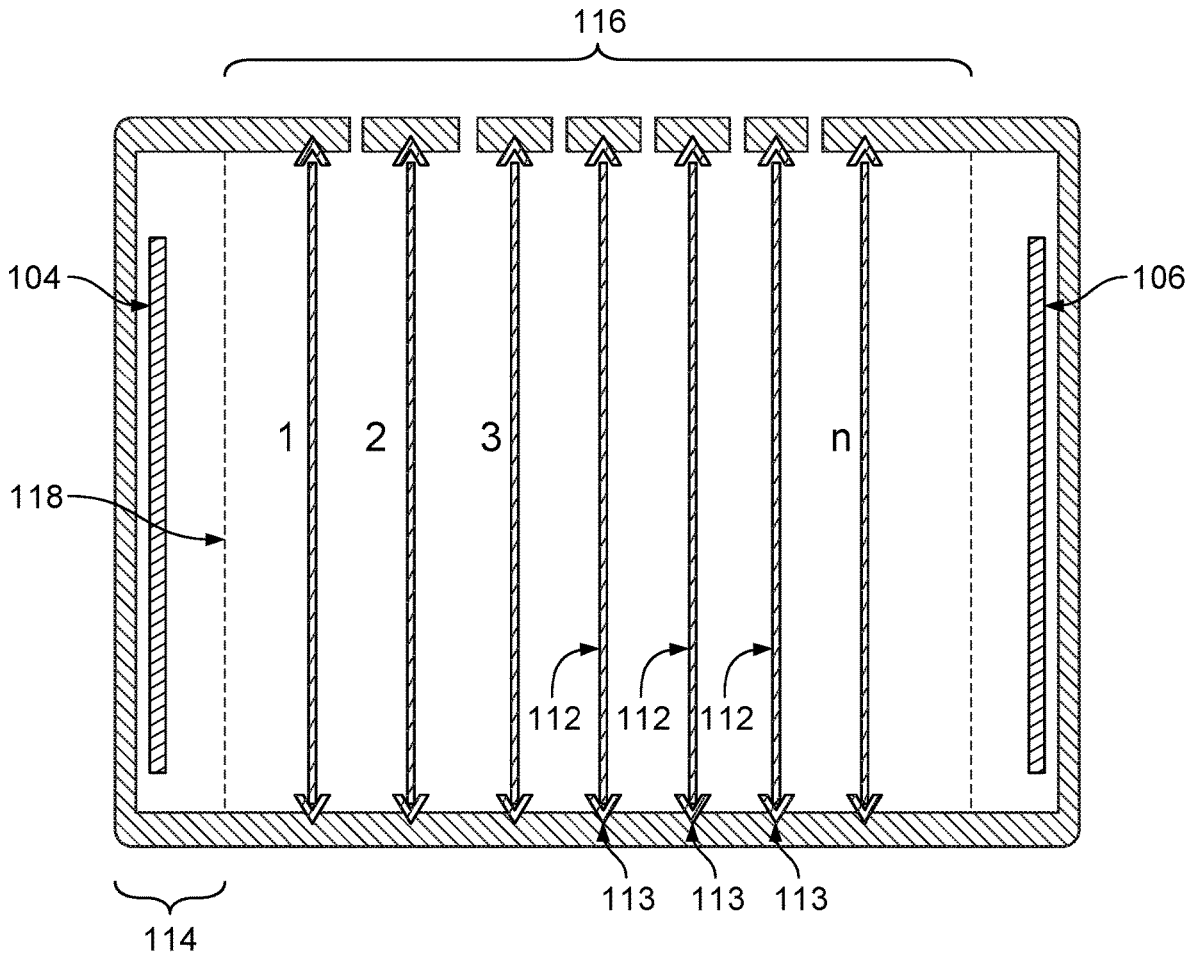
FIG. 2 shows an n-batch stack series array porous silicon electrolytic bath arrangement.

FIG. 2 reveals the basic form of the "n" batch stack series array—an embodiment of this disclosure. In this arrangement wafers 112 are stacked substantially parallel with respect to one another and may be oriented vertically (or alternatively horizontally or in other orientations) with the electrode assembly on either end of the batch reactor or bath. Wafers 112 are held in place by wafer clamps 113. The number of wafers can be increased from 1 to n (with n being a minimum of 2 and a maximum at least in the tens of wafers) and large number of wafers can be stacked just by increasing the length of the reactor. The maximum value of "n" is based on the acceptable size of the batch reactor for the optimal tool foot print, chemical utilization, required electric power for "n" wafers, etc. Processing multiple wafers plays nicely into cost-of-ownership (CoO) reduction. The key advantages of this batch design are the ability to share the chemical electrolyte bath, use a single pair of electrodes and reduce overall materials/components required in this multi-wafer scheme.

Details about the individual components of the batch reactor are explained below.

Electrode Assembly/Electrode Chamber

The embodiment includes multiple architecture of the electrode assembly. The simple version is a solid electrode plate or a film etc. The inert electrode, such as diamond, graphite, platinum, or any other suitable material, does not corrode or etch during the electrochemical reaction. The second embodiment of the electrode assembly is a compartmentalized electrode chamber as shown in FIG. 2. In this case, electrode chambers 114 are separated from reaction chamber 116, which holds the actual process electrolyte and the wafers. The electrode chamber is separated from the process chamber by the means of conducting membrane 118 (allows electric field to pass through but prevents the transfer of chemical ions and molecules). The membrane can be self-standing or be sandwiched by some perforated non conducting plates to provide mechanical stability. This separation or compartmentalization allows for the use of different electrolyte chemicals (various compositions, chemical components, etc.) in the electrode chambers and the process chambers without interfering with each other.

Process Chamber

Figure 3A:
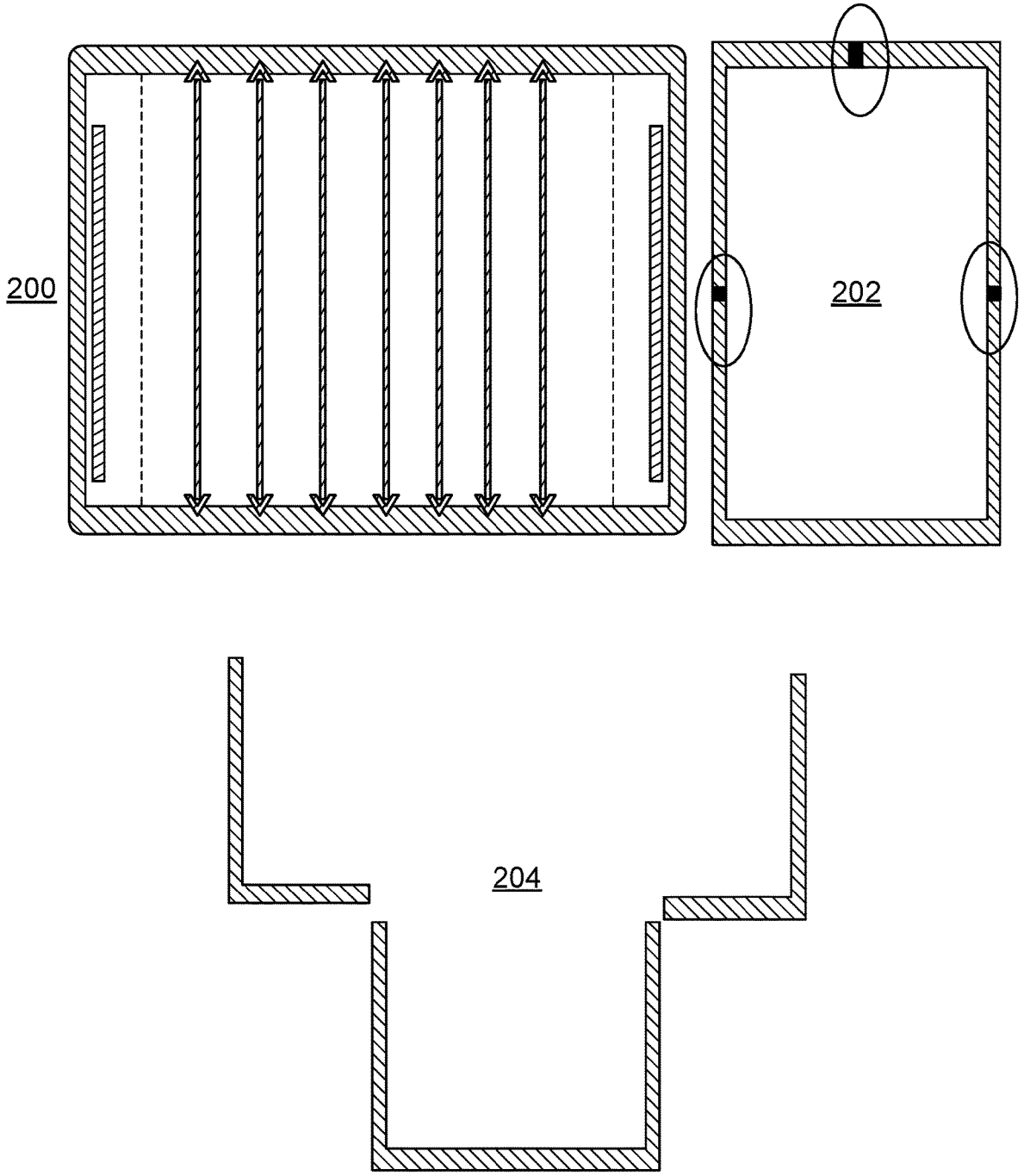
FIG. 3A shows a chamber design for square wafers.
Figure 3B:
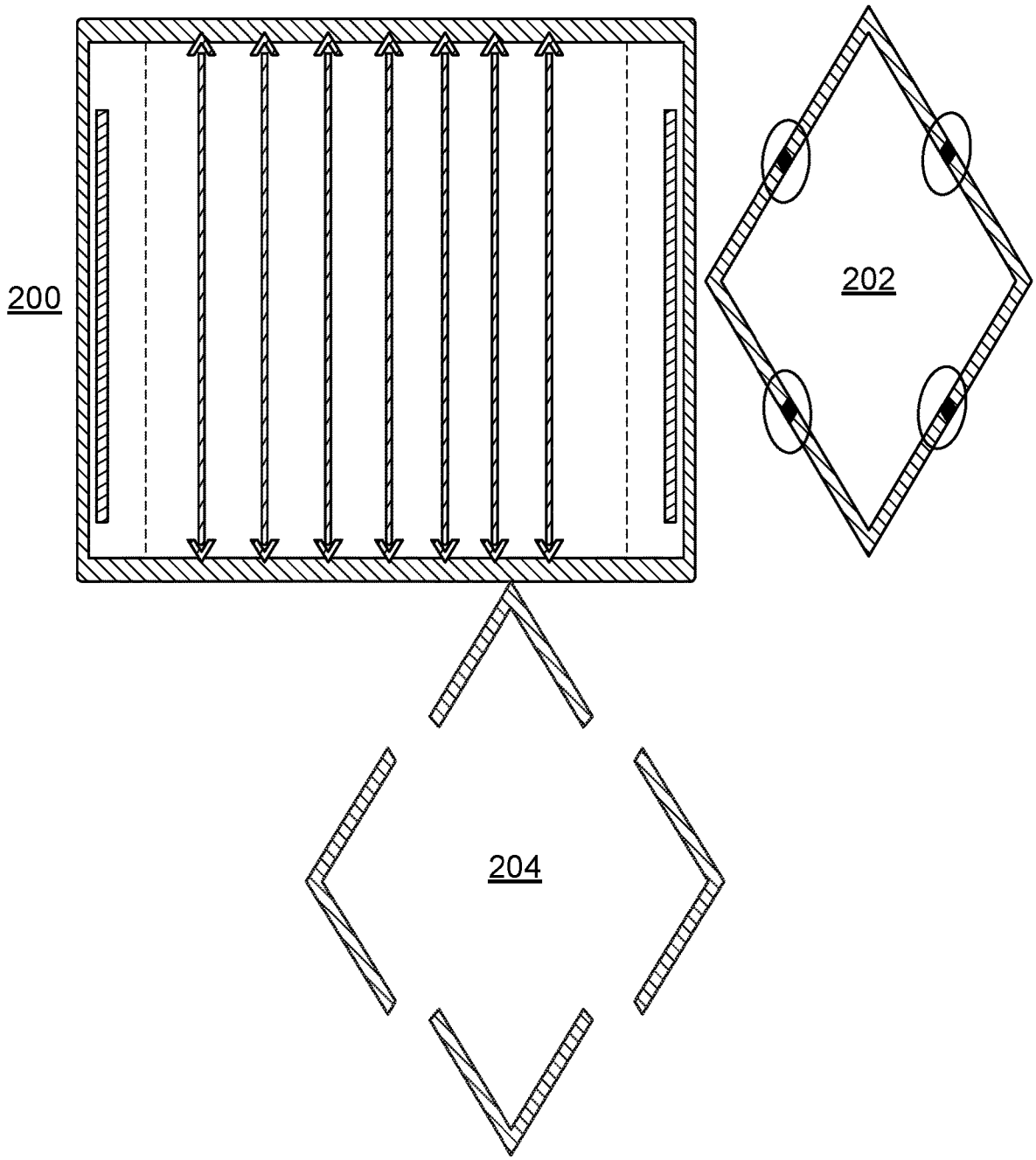
FIG. 3B shows a tilted chamber design for square wafers.
Figure 4:
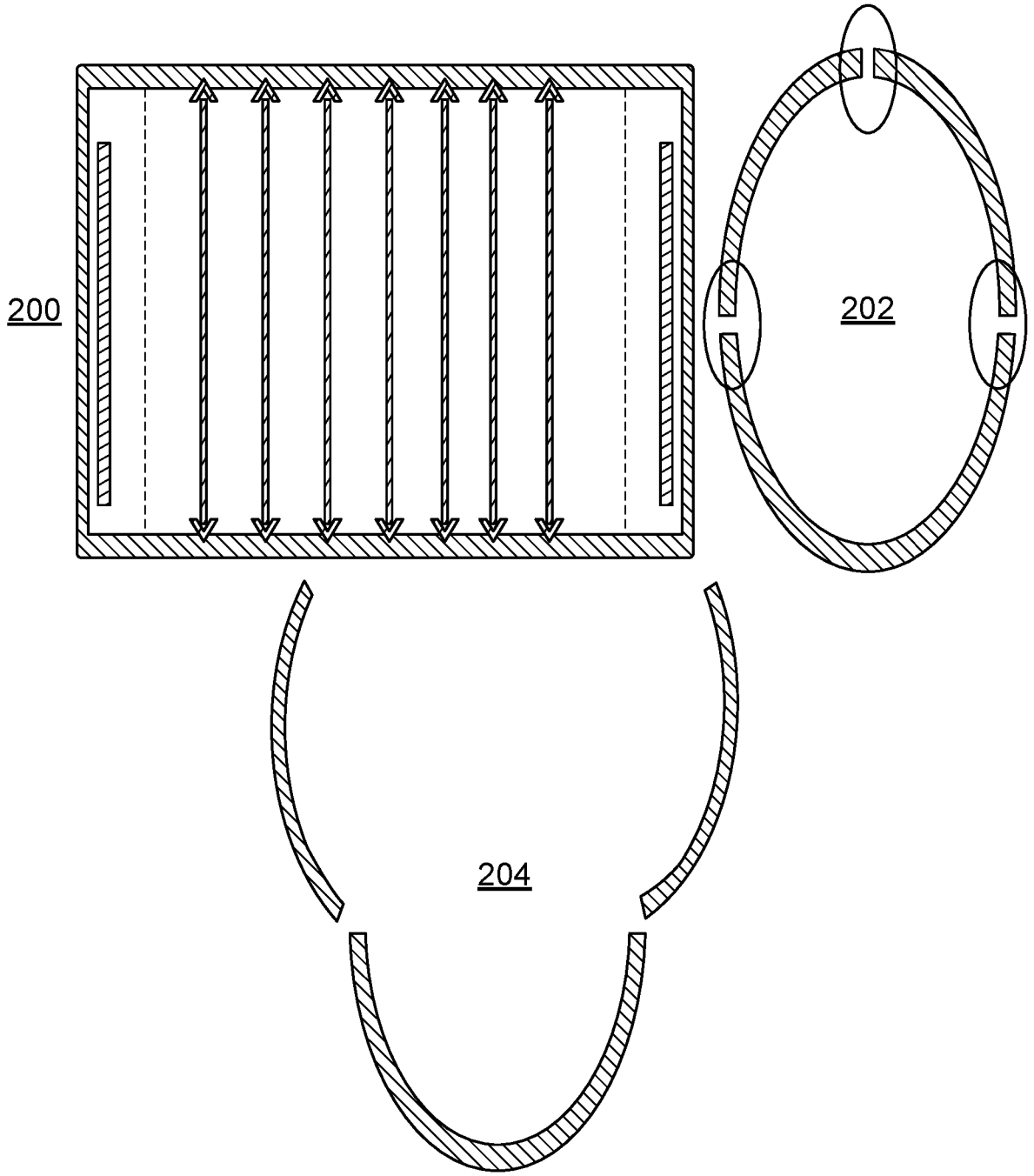
FIG. 4 shows a chamber design for round wafers.

The process chamber holds the wafers and the electrolyte. The embodiment covers a wide range of process chamber dimensions to be able to create porous silicon on wafers of various geometries such as, but not limited to round, square, pseudo square(square with truncated corners) with rounder corners of varying degrees, as well as rectangular structures. Schematics of a 200 mm round and 165 mm square process chambers are shown in FIGS. 3A, 3B, and 4. Each of those figures shows side view 200, closed sectional view 202, and open sectional view 204.

The substrates involved may be essentially flat with varying degree of roughness or may be structured to form 3-dimensional patterns or structured with films that locally inhibit or enable porous silicon formation.

The process chambers are envisioned to be able to open in multiple sections, like a clam shell as shown in FIGS. 3A, 3B, and 4. This allows easy loading of a batch of wafers (n wafers at a time) when the upper portions of the chamber walls are open. Once the wafers are secured in the lower portion of the chamber, the sides and top portion of the chamber close/latch around the wafers. This creates a hermetic seal between the chamber wall and each individual wafer. This is extremely critical as the electric field from the electrodes on either end of the process chamber is required to pass through the wafers to form relatively uniform and repeatable porous silicon layers. The chamber of the square wafer can be installed with a wide variety of tilt from 0 degree (as shown in FIG. 3A) to 45 degree (as shown in FIG. 3B). The wide range of tilt or wafer orientation allows for the choice of optimal chemical flow and gas escape during the anodization process.

Wafer Holders and Seal

Figure 5:
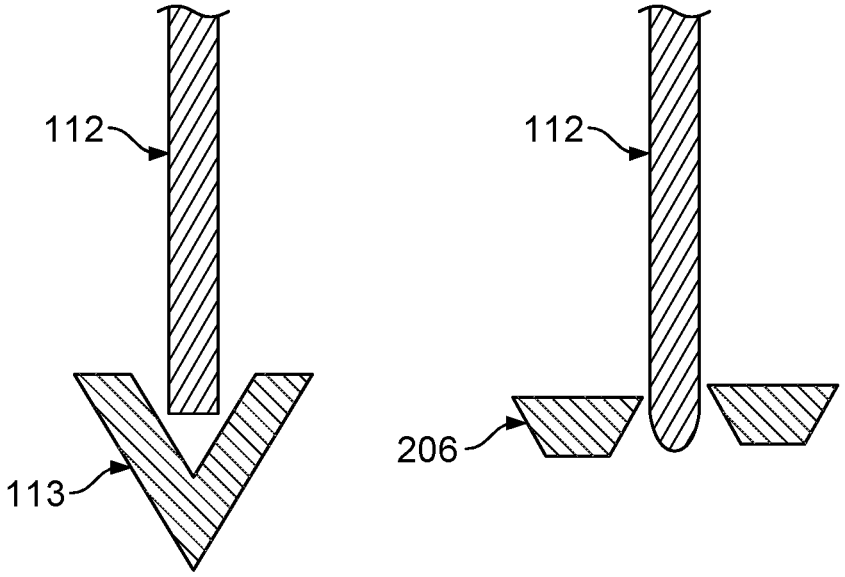
FIG. 5 shows two designs for wafer clamps.

A key requirement of the porous silicon process is to get substantially uniform porous silicon coverage on the full surface of the wafer, in some embodiments without any edge exclusions. This requires that no areas of wafer edge should be blocked or covered by any material that will prevent uniform electric field distribution and direct contact with the chemistry. One embodiment covers designs of mechanical features that can hold the wafer in place, but with zero to negligible contact points and blocking points on the wafer. As shown in FIG. 2, a simple clamp type wafer holder may be used to enable this capability. An enlarged image of the wafer holder is shown in FIG. 5. Wafer clamp 206 lacks this desirable property, preventing the formation of PS around the edge of the wafer.

Another critical item is the choice of sealing material around the inner walls of the process chamber. The chamber walls will be lined with either a single layer of chemically inert (HF and organic resistant) insulating rubber or foam to provide a leak-free seal between the wafer edge and the chamber wall or the wafer holders. This is critical to prevent any chemical leak or electric field leakage in areas where the clam shell chamber walls lock.

Electric Field Optimization

The batch chamber design with the compartmentalized electrode chamber allows for electric modulation as well. The parameters such as electrode dimension, gap between electrode and closest wafer, gap from wafer to wafer, etc. may easily be modified to achieve the required uniformity for the electric field. Another key component is the spacers used to hold the membrane discussed above. The shape and patterns on the insulating spacer may also be modified to achieve the best electric field uniformity on the wafer. In circumstances where a varying electric field (thereby varying thickness or porosity of porous silicon) is required for the integrated process flow, the spacer design can be used to control the required electric field without changing the chamber design.

Fluid Flow and Hydrogen Vent

Figure 6:
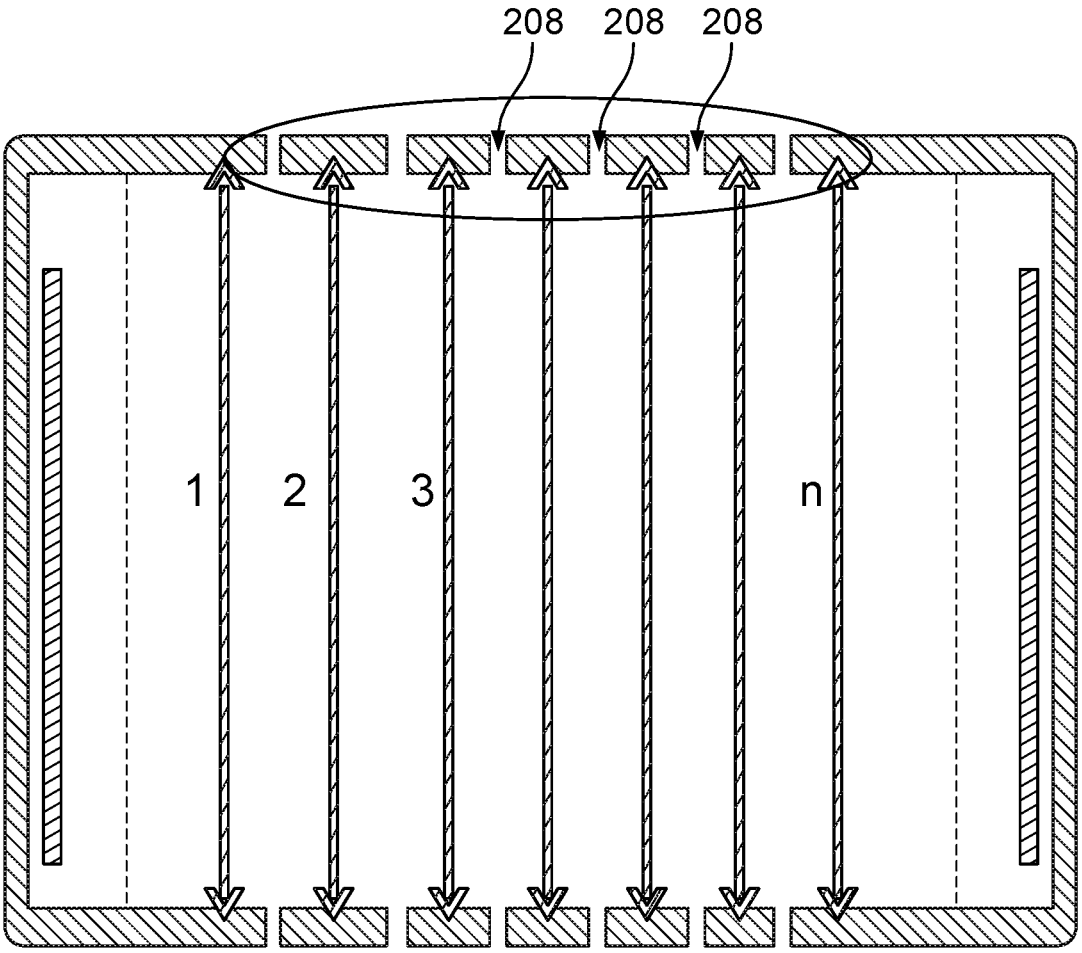
FIG. 6 shows a chamber design with fluid fill and vent ports.

The chamber may be designed with fluid fill and vent ports 208 on the top of the chamber as shown in FIG. 6. As shown, this embodiment also includes designs of fluid inlet and outlet ports at other locations of the chamber to achieve the best electrolyte replenishment to the wafer (to minimize the impact of reaction byproducts) and maintain a consistent chemical concentration.

One challenge with any porous silicon chamber is handling the hydrogen ($H_2$) gas generated as a result of the anodic etch reaction. Hydrogen evolves from the surface of the wafer and each electrode. Since the bath is integral with electrical current transmission, $H_2$ gas blocks current flow and supply of chemicals to the reaction surface, thus affecting porous silicon formation and continuity/uniformity. It is therefore critical to effectively and rapidly purge or sweep $H_2$ byproducts from the surfaces of the wafer and electrodes. The wafer gap, fluid flow and design of the flow ports determine the effectiveness of the sweep. While sweeping $H_2$ is fairly simple in terms of fluid mechanics, some consideration is warranted to mitigate the current loss from the fluid ports. Since the fluid lines are connected from wafer to wafer, depending on the geometry of the ports, line size and length, current can leak or bypass each wafer. Therefore, isolation of each port is advantageous. Also, for example, reducing the line diameter and increasing the length results in greater electrical resistance which reduces current losses or bypass losses. The current field lines are also influenced by the geometry adjacent to the wafer. So, large flow ports are less desirable compared to multiple small ports.

Bath in Bath Design

Figure 7A:
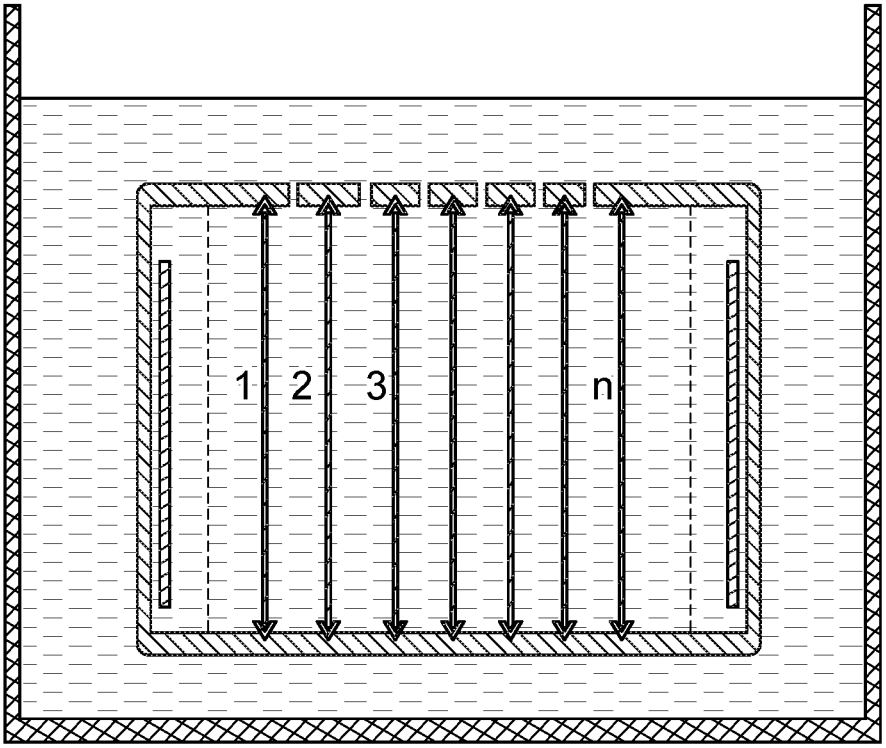
FIG. 7A shows a bath-in-bath chamber design.
Figure 7B:
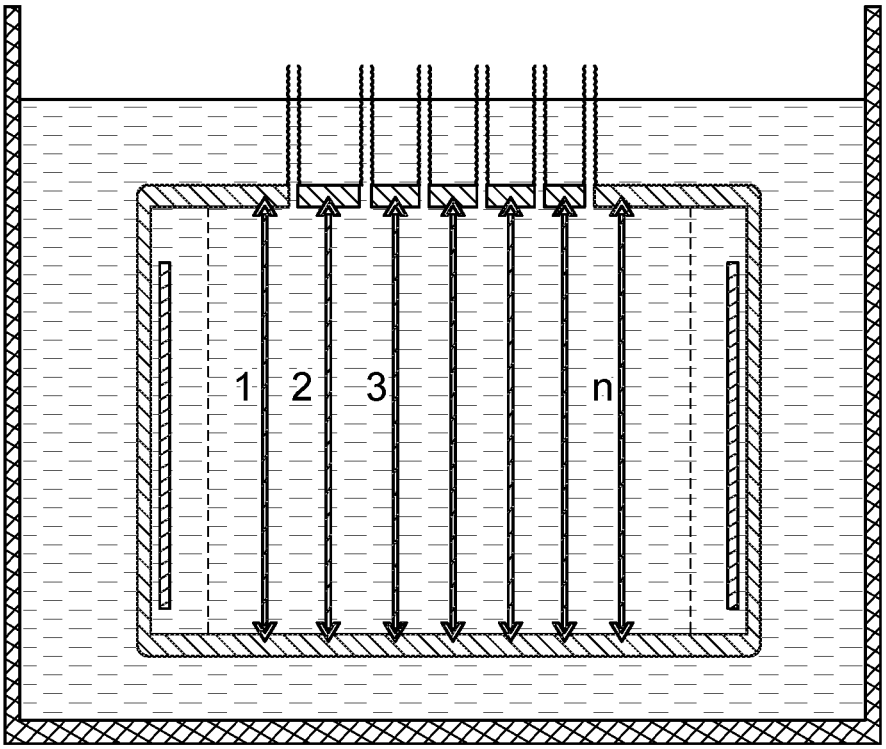
FIG. 7B shows another embodiment of a bath-in-bath chamber design.

Typical wet chemical baths and process chambers use direct fluid fill/drain of the process chamber, wherein the chemical is directly pumped in the process chamber. This may require additional fill and drain times before the process can start and results in loss of productivity. This embodiment also covers a design termed as "bath in bath" for the PS production as shown in FIGS. 7A and 7B.

There are at least two embodiments of this bath in bath design: a) Prefilled inner chamber that is immersed and lifted out completely into and from the bath; b) Resident bath-in-bath with wafers being handled using auto loader that handles a batch of wafers and that places the batch into the lower holder part of the inside bath, then retreats.

In design a), the process chamber is pre-loaded with wafers and filled with the process chemicals. The entire assembly is then immersed into a larger bath which is pre-filled with the process chemical/electrolyte. The ports/vents on the top of the chamber allow for the electrolyte to fill the process chamber if and when the liquid level drops in the process chamber due to the reaction or other means of loss such as evaporation. Once the process is complete, the process chamber unlocks and is pulled out and the standby process chamber is immediately immersed in the larger bath minimizing loss in productivity due to wafer load/unload and chamber fill and drain. The larger bath is designed with its own pumping and recirculation system to maintain the required concentration and temperature. This methodology allows having multiple process chambers that can be introduced into the main bath without any loss in productivity.

In design b), the chamber is an integral part of the tool or the larger bath and always remains immersed in the main bath, but the chamber can open and close. It is envisioned that loading mechanisms such as robotic handlers can transfer a batch of n wafers into the base of the process chamber. After the wafer handlers have moved away from the process chamber, the outer walls of the process chamber close. This action not only secures the wafers, but also encloses the process chemicals in to the process chamber. The additional vents and ports allow the process chamber to be filled completely to the required level and maintain the same level throughout the process.

In any case, the top of the vent ports may be outside of the liquid, such that an electrically connecting path outside of the inner bath is avoided. This embodiment is shown in FIG. 7B.

The embodiments of design a) and design b) can be combined into a hybrid utilizing the loading mechanism from design a) and the sealing mechanism from design b). In this hybrid design, the bottom section of the chamber remains in the outer bath. The wafers are pre-loaded into the top (and side) portion of the chamber, which acts both as a handling mechanism and a partial chamber. The preloaded wafers are then immersed in the outer bath until the wafers make contact with the lower portion of the chamber. The chamber walls are then closed tight with an actuator mechanism ensuring a leak-proof chamber.

The batch porous silicon equipment design embodiments described above can be used to form either single-layer or multi-layer porous silicon on one or both sides of the wafers in the batch. Porous silicon can be formed on only one side of the wafers by applying the electrical current flowing in only one direction without a change in the current polarity. On the other hand, porous silicon can be formed on both sides of the wafers by alternating the current flow direction at least once or multiple times. The electrical current density (in conjunction with the HF concentration) controls the layer porosity. Thus, the layer porosity can be increased by increasing the electrical current density and conversely can be reduced by reducing the electrical current density. Multi-layer porous silicon can be formed by modulating or changing the electrical current level in time during the porous silicon formation process. For instance, starting the porous silicon process with a lower current density followed by a higher current density results in formation of a lower porosity layer on top of a higher porosity buried layer. A graded porosity porous silicon layer may be formed by, for instance, linearly modulating or varying the electrical current density in time. One can use this approach to form any porous silicon structure with one to many porous silicon layers with one to many porosity values.

FIGS. 8-16B and the following corresponding description relate more directly to the subject matter disclosed in the present application which provides process flows, unit processes, apparatuses, and variations thereof which enable the controlled formation of one or more uniform layers of porous semiconductor or silicon (PS) on top of semiconductor or silicon templates. These processes and apparatuses allow for the controlled formation of uniform layer or layers of porous silicon (PS) in a batch mode—which means the formation of PS on a plurality of wafers at the same time with substantially uniform distribution of porosity and thickness of the PS layers.

A key factor in the uniform anodization of a wafer surface in a bath reactor is the suppression and minimization of the quantity, density, and impact of gas bubbles formed during the anodization process. As a semiconductor gets anodized in an etching fluid (consisting of HF and typically an additive, such as an alcohol, to reduce the surface tension), a byproduct of the reaction is the liberation of gas bubbles, substantially hydrogen gas bubbles. In a substantially vertical reactor arrangement where the wafers are immersed and held vertically or at least to a substantial angle away from the horizontal direction within the anodization bath, such as that shown in FIG. 9, hydrogen bubbles tend to accumulate towards the top of the reaction chamber as the bubbles move towards the surface of the etching fluid. The effect of these bubbles may cause non-uniform anodization at the top of the wafer, or even blistering of layers, especially when forming a low porosity layer over higher porosity layer on the wafer surface.

All or some of the disclosed bubble mitigation systems and methods herein may be combined for an optimized anodization result. One disclosed solution employs the use of sonic energy, such as ultrasonic or megasonic transducers coupled to the fluid bath or to the wafer holder, to effectively dislodge and liberate such bubbles from the surface.

Figure 8:
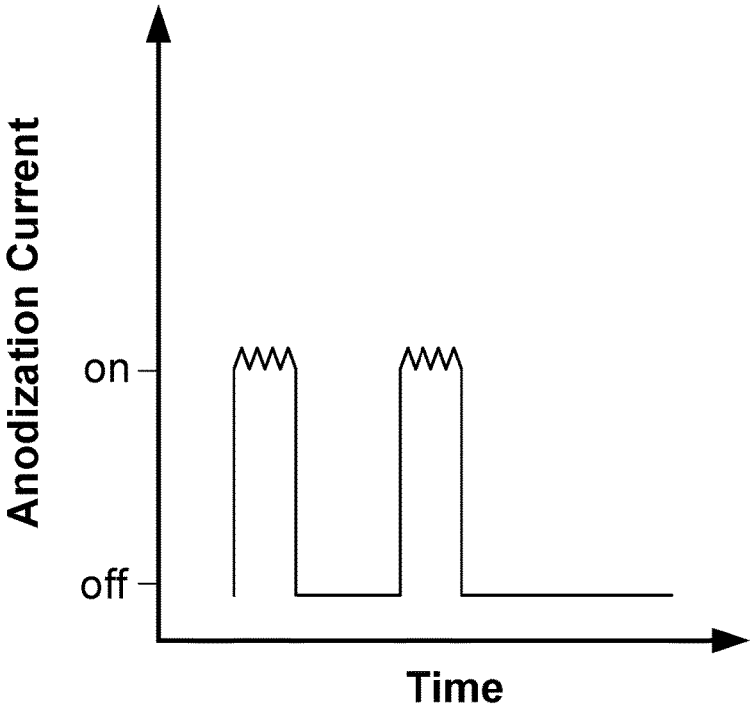

Another disclosed solution utilizes pulsed anodization—the current is pulsed on and off as shown in the graph in FIG. 8—where the formation of the anodization is pulsed to give the hydrogen bubbles that are formed during the reaction sufficient time to travel up and away through a vent hole, or a plurality of vent holes, at the top or along the upper edges of the chamber or wafer tunnel. The bubbles may also be swept away by an upwards chemical flow. It is to be noted that the formation of a high porosity layer is typically accomplished at a substantially higher electrical current than the formation of a low porosity layer. Also, the anodization speed, in terms of anodizing a certain thickness of film, increases with the current (i.e., higher porosity films form faster than lower porosity films). Therefore, high porosity films typically take less time to form but generate more hydrogen per unit time, making the formation of higher porosity films susceptible to hydrogen bubble-induced uniformity problems. Thus, if a plurality of layers with at least one lower porosity layer is formed, the throughput loss from forming the high porosity layer in a pulsed fashion is comparatively minor.

A third disclosed embodiment utilizes fluid transport to dislodge gas bubbles while the anodization is in an off-state. In the current-off state during anodization pulsing, an active fluid transport which sweeps the hydrogen gas away may be turned on—the fluid transport is left turned off during the anodization. This method may be beneficial to the uniformity of the electrical field, as a moving electrolyte tends to carry electrical field lines with it and can cause field distortions.

Alternatively, suitably directed fluid flow during the anodization may also be utilized to create a uniform overall anodization result. To enable fluid flow during the anodization, proper care needs to be taken to avoid contact of fluid volumes from the different fluid compartments between wafers. An exemplary system that may be used to push liquid through the reactor are separate tubes connected to the bottom of each compartment. Through these tubes, the liquid is pushed across the wafers thus displacing other liquid and bubbles through the vent holes on the upper part of the chamber. One skilled in the art may envision various methods and systems for keeping the replenishing fluids as well as the displaced fluids between individual compartments separated.

Yet another alternative method for bubble removal utilizes a suitable vacuum, which may be for instance applied to the vent holes of the anodization chamber.

In order to sweep bubbles away from active surfaces that are to be anodized, it may also be helpful to have a small fluid volume above the wafers, where bubbles will drift to due to an effect of buoyancy.

The electrical power dissipation per wafer in the batch porous silicon tool may be reduced by adding a suitable additive such as a salt or an acid to the anodization bath in order to enhance its electrical conductivity without any detrimental impact on the anodization chemistry and process. An increase in the electrical conductivity of the batch porous silicon bath through a suitable conductivity-enhancement additive such as a chemically-benign salt or acid not only reduces the electrical power dissipation per wafer but also enables an increase in the wafer batch size by reducing the wafer-to-wafer spacing within the bath. The reduction in wafer-to-wafer spacing may be achieved because it is possible within a more conductive electrolyte to equalize the electric field strength across a smaller distance—thus enabling smaller wafer-to-wafer compartments and allowing for an increase in wafer batch size.

Figure 9:
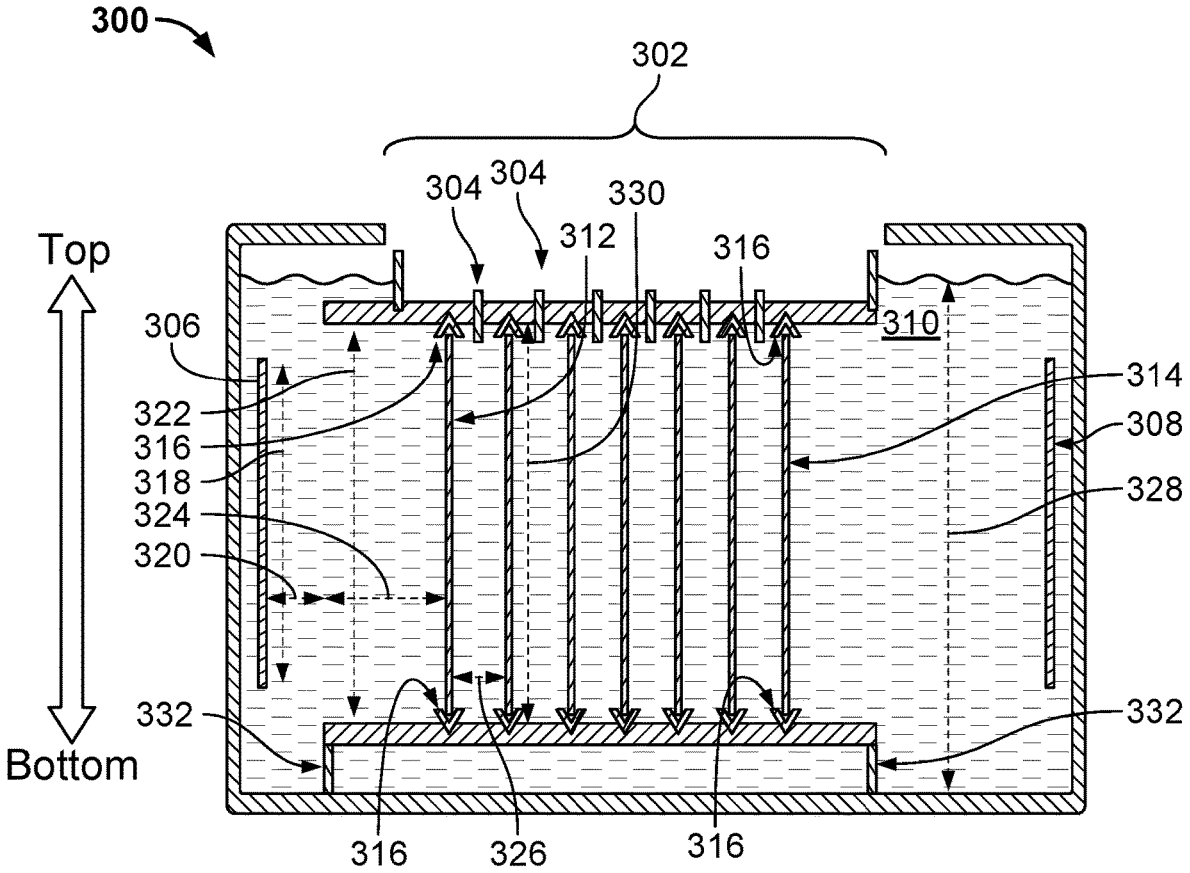

FIG. 9 is a diagram depicting an embodiment of stacked batch anodizing tool 300. Key components of the tool include anode 306 and cathode 308 (both facing the wafers), and wafer chamber 302 supporting an n-dimensional array of wafers, such as wafer 312 through 314, held in place by wafer clamps 316 in electrolyte solution 310 filled in the compartment to height 328. Vent holes 304 provide access to each fluid filled wafer compartment created between two wafers positioned in series. Anode 306, having electrode region size 318, is positioned a certain distance from the wafer chamber, shown as distance 320, and the first wafer, wafer 312, is positioned a certain distance from the beginning of the wafer chamber, shown as field shaping distance 324. Seals 332 define the wafer tunnel and help to prevent additional current paths between the electrodes other than that within the tunnel and through the wafers. The wafer tunnel has height 322 (also called tunnel size) and each fluid filled compartment between two wafers has width 326 and height (also called compartment size and compartment size diameter) 330.

For a uniform anodization result, it is important to have a substantially uniform electrical field across each wafer. In a stacked batch array (horizontal, vertical or angled), special importance is given to the wafer closest to the cathode, shown as wafer 314 in FIG. 9. In an optimized bath arrangement, the diameter of the space between wafers mimics the wafer size, i.e. if the wafers were round or square with a certain diameter or diagonal, it is beneficial to have the diameter of the space between the wafers, called the compartment size and shown as width 330 in FIG. 9, approach similar dimensions. The same distance parameters also hold in general between the first wafer, wafer 312, and the anode and last wafer, wafer 314, and the cathode. Therefore, a 'tunnel' arrangement between the electrode and the first wafer with a similar height dimension to the wafer itself, shown as tunnel size 322 in FIG. 9, is employed to help provide improved uniformity.

There are however reasons it may be beneficial to have the diameter of the compartment size be slightly larger than the wafer diameter. One consideration is that at least above the wafer, a compartment size 330 larger than the size of the wafer, while connected to the vent hole or holes, allows for bubbles to be temporarily stored during the anodization without being in the direct path of the anodization current. Another consideration is that in the case that the sealing at the wafer edge is asymmetric, as is described below, the additional fluid space between wafers allows the electric field to equalize towards the wafer edge.

When the electrodes have similar size as the wafers to be anodized, such as the configuration shown in FIG. 9 with wafer size substantially equivalent to compartment size 330, it may be beneficial that the tunnel pieces between electrodes and first and last wafers, also resemble a similar shape and size as the wafers—in FIG. 9 this shown as the area having width 324 and height 322 between the electrode and wafer 312. The tunnel dimensions, width 324 and height 322, are called "field shaping tunnel distance" and "tunnel size" respectively. Tunnel size 322 should be substantially similar to wafer size and tunnel distance 324 is preferably large enough to form a homogenized uniform electric field across the wafer. And often a larger field shaping tunnel distance is advantageous. For some electrode sizes it is also advantageous that the dimension called "electrode region size", shown as 318 in FIG. 9, is kept similar to the tunnel size and wafer size.

Another important consideration is that all the current between the electrodes, anode 306 and cathode 308, to flow through the stack of wafers to be anodized—thus there should be no parallel connecting fluid path between the electrodes which would divert current from the wafer stack. Such a parallel fluid path would be detrimental to overall power loss, as well as controllability and matching of performance between different baths. Seals 332 in FIG. 9 illustrate an example for preventing an external fluid and current leakage path. Another solution is to position a separate fluid supply for each compartment in order to prevent leakage from the fluid supplies. However, in cases where such a parallel path cannot be avoided, then it is advantageous to measure the current by measuring voltage drops between different points across the parallel paths. This measurement is useful for analytical as well as bath control purposes.

Figure 10:
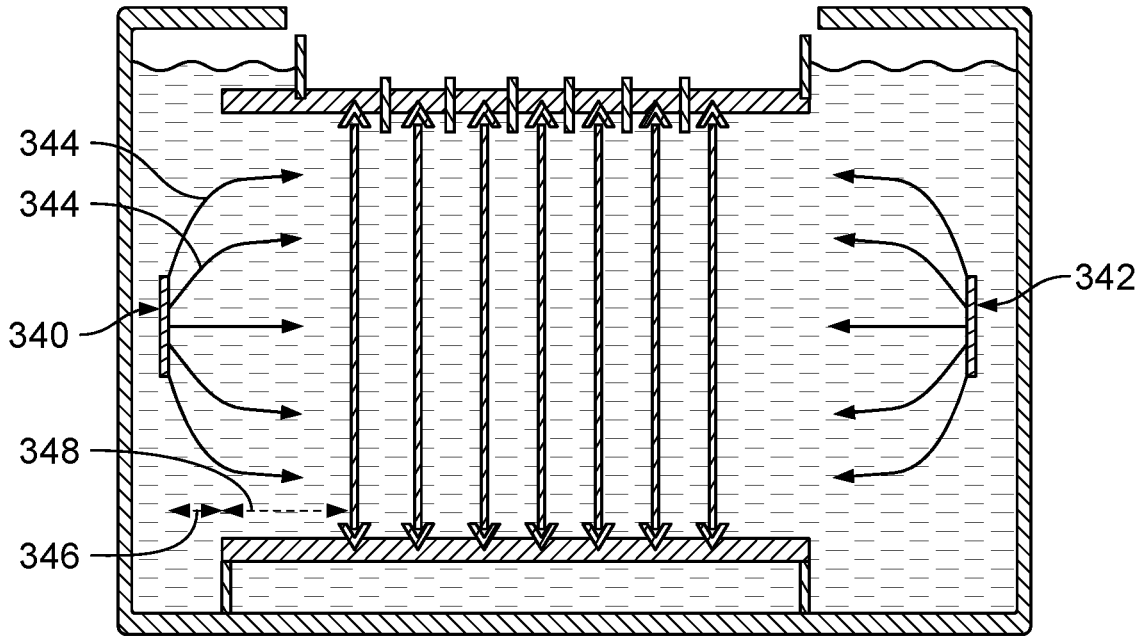
Figure 11:
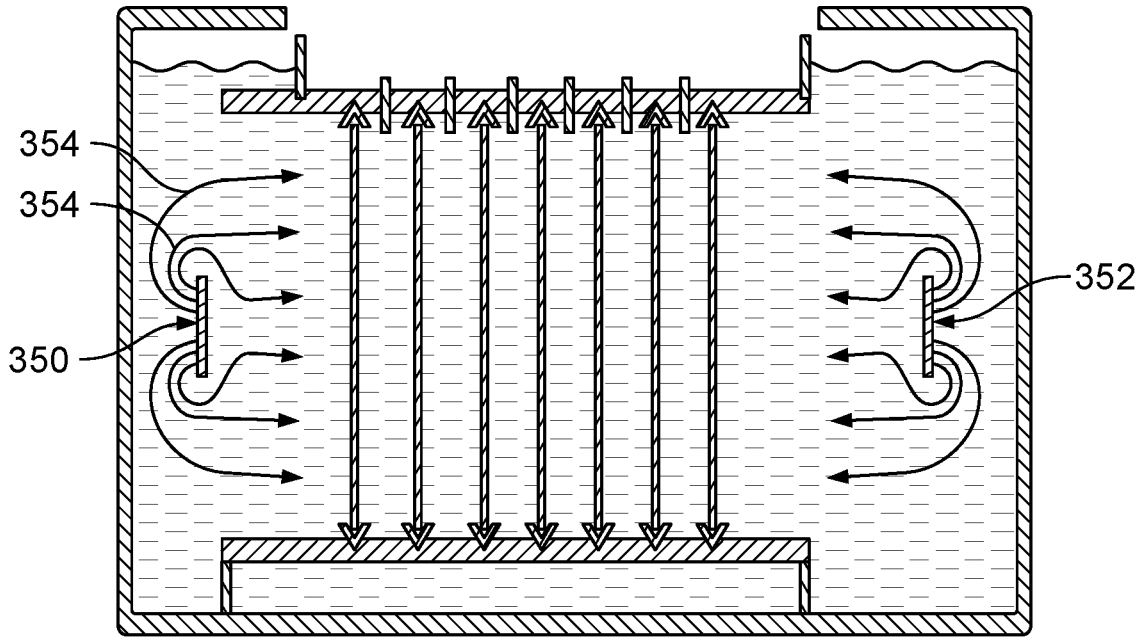
Figure 12:
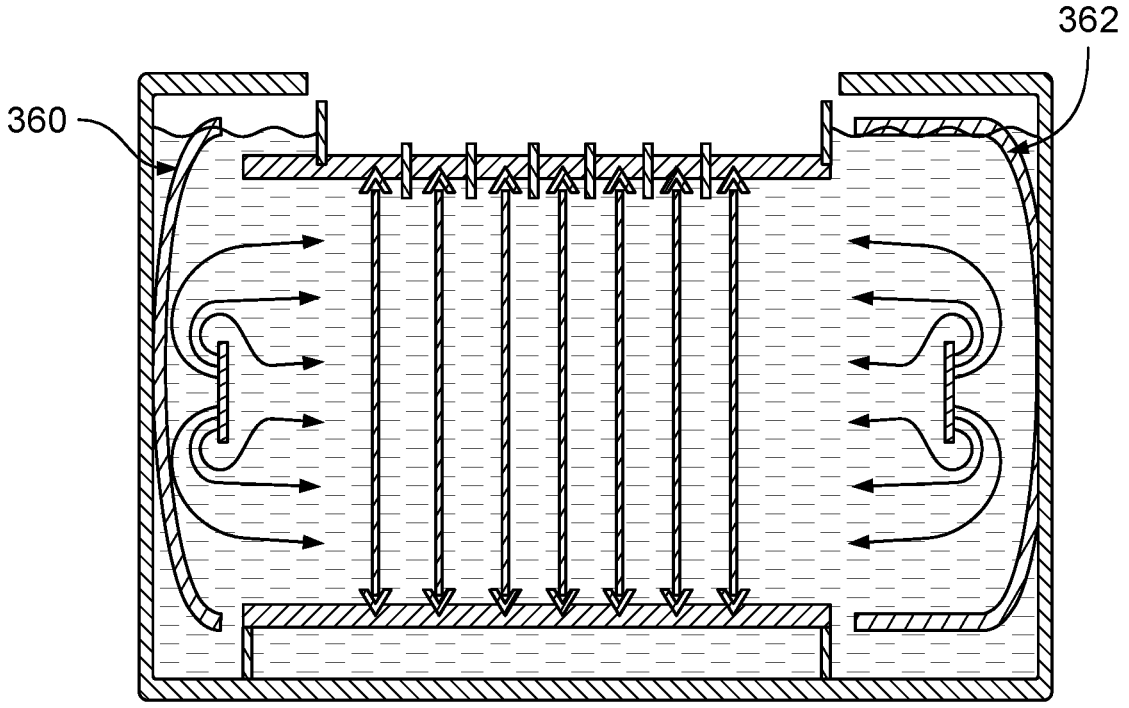

FIGS. 10 through 12 are diagrams depicting several embodiments of a stacked batch anodizing tool highlighting various electrode positions. The structural features depicted in the diagrams of FIGS. 10 through 12 are consistent with FIG. 9 unless otherwise noted.

For the anodization process, it is often necessary to use electrodes that are chemically very inert. Such electrodes tend to be costly which increases substantially with the electrodes size. Therefore, to decrease the overall tool cost it is advantageous to have small electrodes and utilize suitable field shaping to optimally expand the electric field and provide a uniform electric field for the anodization.

To expand the electric field the electrode may be placed at a larger distance from the first and/or last wafer in order to make use of the electrolyte's conductivity to distribute the field evenly—thus increasing/adjusting the distances 320 and 324 in FIG. 9. Although not drawn to scale, in FIG. 10 small anode 340 and small cathode 342 have been positioned further from the first and last wafers to allow for electric field homogenization before the first wafers are reached, the field is shown in FIG. 10 as field lines 344. Thus the distances 346 and 348 combined are larger than distances 320 and 324 in FIG. 9. And additional electric field improvement may also be achieved by adding a conductivity-enhancement additive such as a suitable salt or acid to the anodization bath.

In FIG. 9, anode 306 and cathode 308 face inwards, or towards the wafers. However, to expand the electric field the electrode may be positioned facing away from the wafers to be anodized—as shown in FIGS. 11 and 12.

In FIG. 11, small anode 350 and small cathode 352 are facing outwards, or away from the wafers. This geometry, where the electric field generated by the electrode faces away from the wafer can be advantageous, since the field lines, shown as field lines 354, can be shaped readily by the shape of the surrounding tunnel walls.

Further, as shown in FIG. 12, the backside wall of the electrode, the wall that limits the fluid to one side and is shown as anode backside wall 360 and cathode backside wall 362 in FIG. 12, may be shaped to optimized the field shape effectiveness at a minimized distance to the first wafer. This may also help to reduce the ohmic loss due to the voltage drop in the electrolyte, as the electrolyte distance from the electrode to the first wafer plays a large role in the total ohmic loss and therefore electricity consumption of the anodization array. Such a wall may be shaped in a vertical wafer stack arrangement (where wafers are arranged vertically as shown in FIGS. 9-12) or in a horizontal wafer stack arrangement. In the case of a horizontal wafer stack arrangement, a pre-shaped (dome-shaped) wall above the electrode may likely require one or several perforations to avoid trapping gas underneath the dome.

As shown in the batch anodization arrangements in FIGS. 9-12, the liquid spaces between wafers are essentially compartmentalized by the wafers themselves and seals at the edge of the wafers (wafer clamps 316 in FIG. 9). However, in certain implementations it may be advantageous to be able to control the anodization at the wafer edge and form PS up to or past the apex of the bevel of the wafer. This may conflict with the need to seal off the liquid sections between each wafer, as any fluid leak between compartments tends to cause loss or serious distortion of field lines and loss of anodization current in the vicinity of the leak.

Figure 13A:
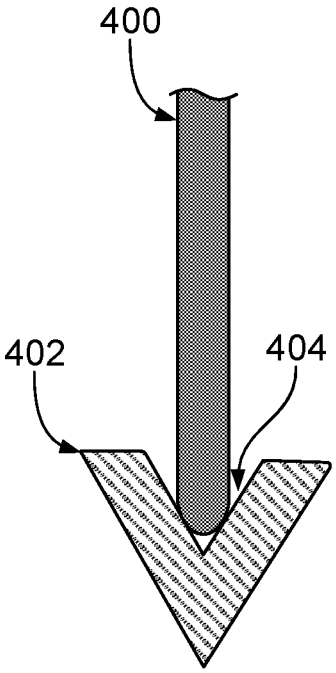
FIG. 13A-13B are diagrams of a symmetric wafer holders.

FIG. 13A is a diagram of symmetric wafer seal 402 holding wafer 400. Seal 402 is applied centrally to the bevel apex of wafer 402 and provides both sealing and clamping of the wafer. The sealing material should be optimized to keep the seal extent as close to the bevel apex as possible to keep the sealing material from excessively wrapping around the wafer edge. Clamping may be performed, for example, by exerting clamping forces by means of a flexible seal to the edge of the wafer, substantially with a force in plane with the wafer plane and vertical to the bevel apex.

However, due to the finite extension of the seal material, which is typically a flexible material, wafer surface areas close to the bevel apex, such as area 404 in FIG. 13, may not receive proper anodization, since the anodization requires that liquid be directly in touch with the surface to be anodized.

To optimize the performance of the seal, the seal must both eliminate fluid leakage around the edge of the wafer and at the same time minimally affect the anodization of the wafer. Thus, the wraparound of the sealing material around the bevel needs to be minimized, as said wraparound prevents areas contacted by the flexible seal from being anodized, while also performing a fluid tight seal.

Figure 13B:
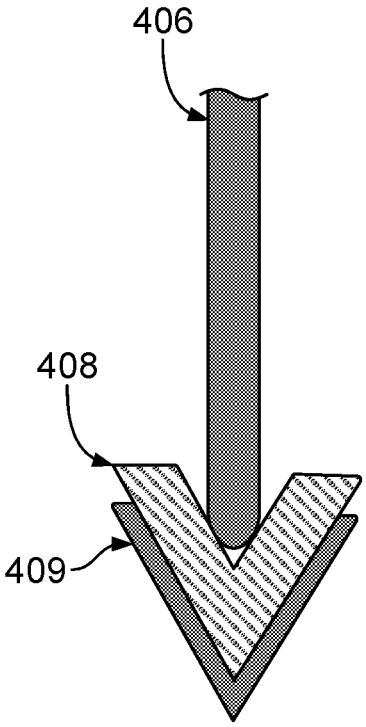

A disclosed solution to the optimization problem stated above and depicted in FIG. 13B includes the use of a seal or sealing arrangement with layers of more than one softness. In this sealing arrangement, wafer 406 clamped by layer 408, called in inner seal layer, which is soft and has a limited thickness such that the wraparound is limited. The next layer, backing layer 409 or outside layer, has a higher hardness while still allowing for long range flexibility. With this combination, the backing layer still allows for adjustments needed to seal adjacent wafers with slightly differing diameters, and the wafer edge wraparound is optimized for perfect sealing while obstructing only a very small part of the bevel. This layer system may be comprised of several material sheets or of one material sheet with a graded softness. Further, this solution would work equally well for single sided and double sided anodization.

Figure 14A:
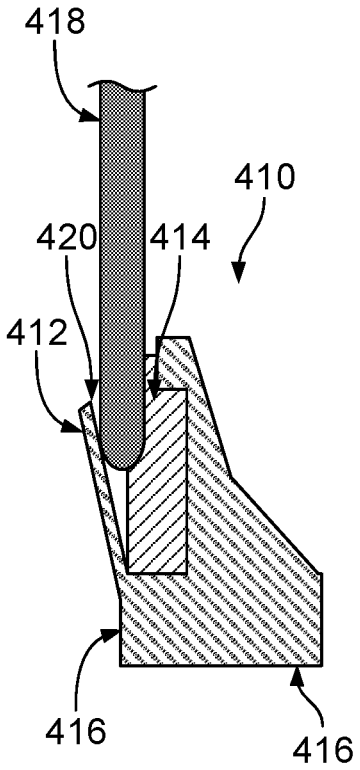
FIG. 14A-B are diagrams of an asymmetric wafer holder.

Another solution allowing for anodization closer to the apex of the bevel is to use a sealing method which keeps the apex of the bevel, or at least the region on the bevel close to the apex, substantially exposed and ready to be anodized. FIG. 14A is a diagram of asymmetric wafer seal 410 holding the backside edge of wafer 418. Asymmetric wafer seal 410 may be utilized in a similar manner to the wafer clamps 316 in stacked batch anodizing tool 300 of FIG. 9. Small slanted pin 412 presses the wafer towards flexible seal contact 414 and only contacts a minimal portion of the waver bevel, shown as contact bevel area 420. Seal holder 416 supports seal contact 414 and pin 412 and may be integrated into the bath chamber wall and allow for suitable electric field shaping geometry (see FIG. 15). The fluid filled compartment between each wafer is sealed by seal contact 414, which is a flexible and chemically resistant material such as, for example, a thermoplastic fluoropolymer (i.e. Polyvinylidene Fluoride PVDF foam), and is positioned substantially along on the backside edge of each wafer.

Figure 14B:
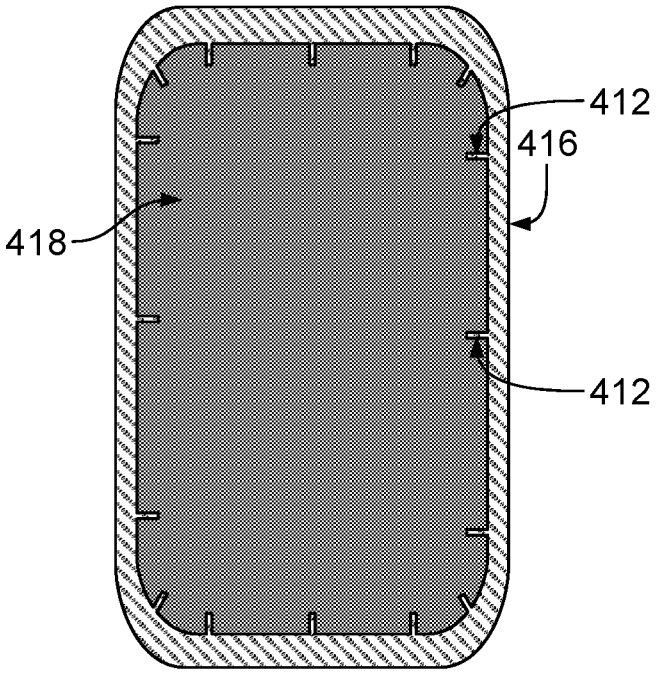

FIG. 14B is a front view, in the direction of the electric field, of asymmetric wafer seal 410 of FIG. 14A holding wafer 418 using slanted pins 412 that touch the front side bevel of the wafer without touching the flat surface area of the wafer—thus providing an asymmetric ring seal (the ring being round or square or pseudo-square, depending on the substrate geometry). For minimal disturbance of the electric field and the anodizing fluid, the dimension and size of the pins should be minimized. Further, the pins may be actuated (active) pins or passive pins wherein the holding force is essentially generated by the elasticity of the seal and/or by flexing of the pins.

Figure 15:
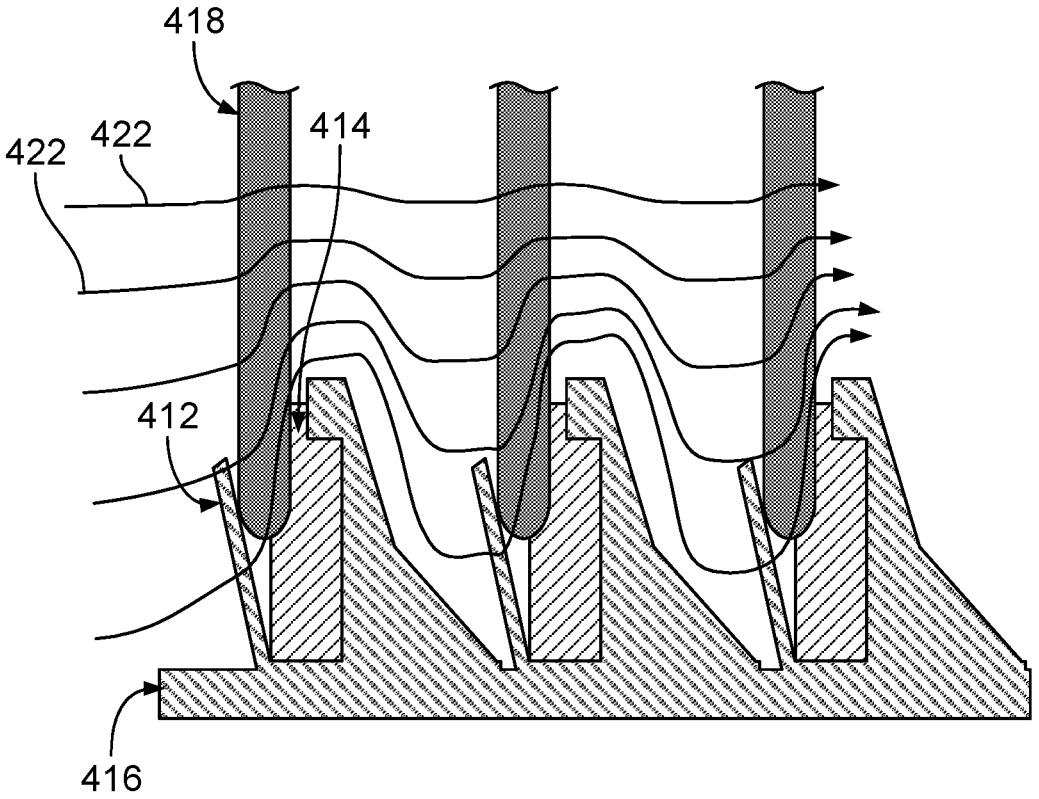

The ring seal inner diameter is to be minimized, in order to allow the field behind each wafer to reshape into a uniform density prior to reaching the next wafer. Suitable field shaping is required here, both from the seal, as well as from the walls limiting the compartmentalized fluid between wafers. FIG. 15 is a diagram illustrating the shaping of the electric field, shown by filed lines 422, in the region of asymmetric seal 410 of FIG. 14 during anodization using a tool such as the stacked batch anodizing tool 300 of FIG. 9. As depicted in FIG. 15, the electric field is reshaped and substantially uniform at each wafer front surface. It is to be noted that one direction of the electric field is depicted in FIG. 15, however, the same holds for current and field pointing in the opposite direction, as is the case for frontside anodization.

Another aspect of ring seal 414 positioned at the backside edge of the wafer is to have a sufficiently large extension to accommodate for a change or variation of wafer diameter or thickness as a function of the re-use of the wafer. The ring seal will typically have a shape substantially similar to the wafer itself, such as circular for a round wafer, square for a square wafer and so on. In another embodiment of this asymmetric seal, the small slanted pins may be replaced by a continuous and suitably slanted wedge.

Figure 16A:
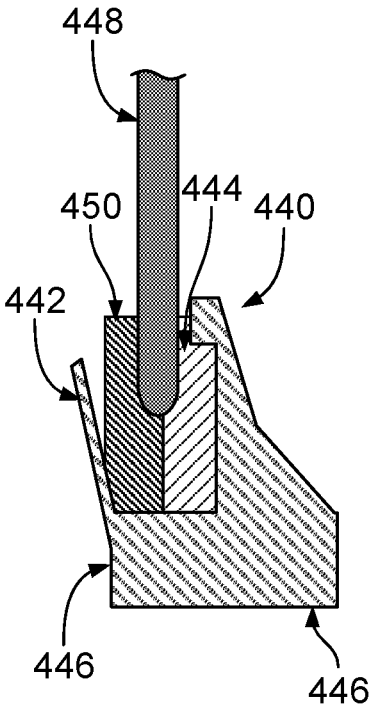
Figure 16B:
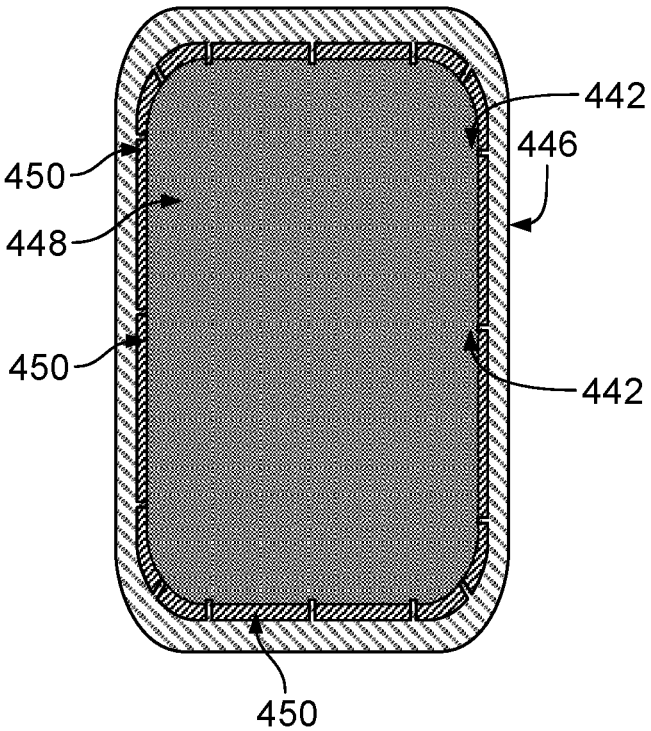

FIGS. 16A and 16B are diagrams depicting an alternative asymmetric seal embodiment. FIG. 16A is a diagram of asymmetric wafer seal 440 holding the backside edge of wafer 448. Asymmetric wafer seal 440 may be utilized in a similar manner to the wafer clamps 316 in stacked batch anodizing tool 300 of FIG. 9. Wafer 448 is held in place by small pin 442 which presses onto porous material 450. Porous material 450 is a suitably soft, sponge-like porous or nanoporous material fluid permeable material, such as PVA or other suitable compatible materials which let both the electric field as well as fluids pass through to the surface of the wafer. This same compressive force from pin 442 is used to press wafer 448 onto compressible seal 444 positioned on the back side of the wafer and which serves to isolate the fluid on one side of the wafer from the fluid on the other side of the wafer. Seal holder 446 supports compressible seal 444, pin 442, and porous material 450 and acts as a sealable ring similarly to seal holder 416 in FIG. 14. In another embodiment of an asymmetric seal, the small slanted pins may be replaced by a continuous and suitably slanted wedge.

Asymmetric wafer seal 440 is similar to asymmetric wafer seal 410 in FIG. 14 except for the addition of porous material 450 positioned along the circumference of the wafer and acts as a compressible sponge-like fluid permeable ring allowing electric field permeations and fluid to contact the front surface of the wafer. In this way, the extent of PS formation may be tuned and extended suitably towards and beyond the apex of the wafer bevel.

And in a further embodiment, the sponge-like material can extend past the edge area and across the whole wafer or large parts of the wafer. Building on this, in another embodiment the fluid filled compartments between the wafers in a stacked batch anodizing tool, such as that of FIG. 9, and optionally also the space between the electrodes and first or last wafer, can be comprised fully of a sponge-like material—thus the wafer chamber of FIG. 9 is filled with a sponge-like material. In such an arrangement, the compressible sponge-like material may first be compressed, then relaxed to facilitate soaking up the etching chemistry prior to turning on the anodization current. In this embodiment, the compressibility and the holding capacity of such a sponge/wafer/sponge/wafer array arrangement may be advantageously used to squeeze out bubbles of the gases developed by the reaction without the danger of generating connecting compartments with respect to electrical or fluid communication. This arrangement may also be used before, during, between or after anodization steps. The sponge like structure, depending on the microscopic structure, may also serve to sufficiently retain the formed bubbles and keep them from accumulating towards the top of the bath where they may lead to non-uniform anodization. Further, this sponge-like layer arrangement may be also used to facilitate easy centering of an edge or backside edge seal gasket between the compartments.

All described arrangements and sealing systems and methods may be optimized by suitable choices of material and geometry that accommodate variations in wafer diameter, thickness, warpage, bevel form, and other shape variations in such a way that reliable sealing of the individual fluid compartments on each side of each wafer is achieved.

In all described embodiments, the wafer holders are suitably segmented to allow for wafer loading and unloading which may be accomplished, for example, by segmenting the whole batch into a clamshell-like design with two or more segments for load and unload or by stacking individual wafer holders, similar to arrangements depicted in FIGS. 3A, 3B and 4. Further, the slanted pins may be passive, i.e. the pressure onto the wafer bevel is exerted just by the loading geometry, or also spring loaded or actuated to exert the necessary clamping pressure.

In the field of photovoltaics, this disclosure enables low cost, high-throughput fabrication of thin film (or thin crystalline semiconductor foil) substrates to be used for solar cell manufacturing by means of a preferably reusable template which can be used repeatedly to fabricate and release said thin film (or thin foil) crystalline semiconductor substrates. The application fields of this disclosure not only include solar photovoltaics, but also other semiconductor areas including microelectromechanical systems (MEMS) and optoelectronics. The field of the disclosure covers several apparatuses and methods for generating uniform layers or multilayers of porous semiconductor with controlled porosity profile across the porous layer (or multilayer) which then may be used as sacrificial release layers for removing a thin film semiconductor substrate deposited on top of a template with the release layer(s). Other applications of the porous semiconductor layers produced by the methods and apparatus of this invention include non-sacrificial applicatons such as formation of anti-reflection coatings, optoelectronics, and layers for chemical sensors, etc.

The foregoing description of the exemplary embodiments is provided to enable any person skilled in the art to make or use the claimed subject matter. Various modifications to these embodiments will be readily apparent to those skilled in the art, and the generic principles defined herein may be applied to other embodiments without the use of the innovative faculty. Thus, the claimed subject matter is not intended to be limited to the embodiments shown herein but is to be accorded the widest scope consistent with the principles and novel features disclosed herein.

It is intended that all such additional systems, methods, features, and advantages that are included within this description be within the scope of the claims.

What is claimed is:

1. An apparatus for producing porous semiconductor on a plurality of semiconductor wafers, comprising:

a chamber, wherein the chamber is operable to open and close, wherein the chamber includes a plurality of wafer holders, wherein each wafer holder is able to secure a surface edge of a wafer, wherein the chamber is fillable with an electrolyte;

an anode disposed at a first end of the chamber; and a cathode disposed at an opposite end of the chamber, the anode and the cathode coupled to electrical circuitry capable of providing an electrical power comprising electrical voltage and current.

2. An apparatus as in claim 1, wherein the chamber includes tunnel pieces between the anode and the cathode to form a tunnel.

3. An apparatus as in claim 2, wherein a tunnel formed by the tunnel pieces has a similar dimension to the wafer held in a wafer holder of the plurality of wafer holders.

4. An apparatus as in claim 2, wherein the tunnel includes one or more vent holes at a top edge of the tunnel.

5. An apparatus as in claim 4, wherein a vacuum is applied to the vent holes at a top edge of the tunnel.

6. An apparatus as in claim 1, wherein the chamber includes a fluid transport to dislodge gas bubbles and push fluid into the chamber.

7. An apparatus as in claim 6, wherein the fluid transport is activated when the electric power is in an off state.

8. An apparatus as in claim 6, wherein the fluid transport is turned off when the electric power is in an on state.

9. An apparatus as in claim 6, wherein the fluid transport generates a separate, independent fluid flow in a compartment formed between two wafers, between a first wafer and the anode, or between a second wafer and the cathode.

10. An apparatus as in claim 9, wherein the compartment has a tube or a flow port to push liquid through the compartment.

11. An apparatus as in claim 10, wherein the tube is able to push the liquid across the surface of the wafer in a wafer holder.

12. A method for providing an apparatus for producing porous semiconductor on a plurality of semiconductor wafers, comprising:

providing a chamber, wherein the chamber is operable to open and close, wherein the chamber includes a plurality of wafer holders, wherein each wafer holder is able to secure a surface edge of a wafer;

providing an anode disposed at a first end of the chamber; and providing a cathode disposed at an opposite end of the chamber, the anode and the cathode coupled to electrical circuitry capable of providing an electrical power comprising electrical voltage and current.

13. A method as in claim 12, wherein the chamber includes tunnel pieces between the anode and the cathode to form a tunnel.

14. A method as in claim 13, wherein a tunnel formed by the tunnel pieces has a similar dimension to the wafer held in a wafer holder of the plurality of wafer holders.

15. A method as in claim 13, wherein the tunnel includes a plurality of vent holes at a top edge of the tunnel.

16. A method as in claim 15, wherein a vacuum is applied to the vent holes at a top edge of the tunnel.

17. A method as in claim 12, wherein the chamber includes a fluid transport to dislodge gas bubbles and push fluid into the chamber.

18. A method as in claim 17, wherein the fluid transport is activated when the electric power is in an off state.

19. A method as in claim 17, wherein the fluid transport is turned off when the electric power is in an on state.

20. A method as in claim 17, wherein the fluid transport generates a separate fluid flow in a compartment formed between two wafers, or between the anode and a first wafer, or between the cathode and a second wafer.

21. A method as in claim 20, wherein the compartment has a tube to push liquid through the compartment.

22. A method as in claim 21, wherein the tube is able to push the liquid across the surface of the wafer in a wafer holder.

* * * * *